US010656590B2

(12) United States Patent
Shiina et al.

(10) Patent No.: US 10,656,590 B2
(45) Date of Patent: May 19, 2020

(54) LOCKING MECHANISM AND IMAGE FORMING APPARATUS

(71) Applicant: CANON KABUSHIKI KAISHA, Tokyo (JP)

(72) Inventors: Sachiyori Shiina, Mishima (JP); Hiroshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/280,988

(22) Filed: Feb. 20, 2019

(65) Prior Publication Data

US 2019/0265635 A1 Aug. 29, 2019

(30) Foreign Application Priority Data

Feb. 27, 2018 (JP) ..... 2018-033616
Nov. 9, 2018 (JP) ..... 2018-211663

(51) Int. Cl.

*G03G 21/16* (2006.01)
*E05B 47/00* (2006.01)
*E05B 65/00* (2006.01)

(52) U.S. Cl.

CPC ..... *G03G 21/1633* (2013.01); *E05B 47/0004* (2013.01); *E05B 47/0038* (2013.01); *E05B 65/006* (2013.01); *G03G 21/1647* (2013.01); *G03G 2221/169* (2013.01); *G03G 2221/1654* (2013.01)

(58) Field of Classification Search

None

See application file for complete search history.

(56) References Cited

U.S. PATENT DOCUMENTS

| | | | | |
|---|---|---|---|---|
| 6,768,877 | B2 | 7/2004 | Alegria et al. | |
| 8,396,379 | B2 | 3/2013 | Tsukijima | |
| 2010/0272452 | A1* | 10/2010 | Tsukijima | G03G 15/553 399/27 |
| 2015/0267442 | A1* | 9/2015 | Zhang | E05B 15/0086 292/139 |

FOREIGN PATENT DOCUMENTS

| | | | |
|---|---|---|---|
| EP | 0468751 | A2 | 2/1992 |
| EP | 0580330 | A2 | 1/1994 |
| JP | S61-151991 | A | 7/1986 |
| JP | H082794 | A | 1/1996 |
| JP | 4842866 | B2 | 12/2011 |

* cited by examiner

*Primary Examiner* — Victor Verbitsky

(74) *Attorney, Agent, or Firm* — Canon U.S.A., Inc. IP Division

(57) ABSTRACT

Provided is a locking mechanism in which when the urging force of an urging member is larger than the magnetic force of a magnet in the non-excited state, a plunger can be held at a first position, and when the urging force of the urging member is smaller than the magnetic force of the magnet in the non-excited state, the plunger can be held at a second position.

9 Claims, 24 Drawing Sheets

LOCKING MECHANISM AND IMAGE FORMING APPARATUS

BACKGROUND OF THE INVENTION

Field of the Invention

The present invention relates to a locking mechanism for locking an object and an image forming apparatus.

Description of the Related Art

In image forming apparatuses such as laser printers, ink jet printers, copiers, etc., a consumable such as a cartridge is generally replaced by the user at a predetermined timing. On the other hand, in some companies, it is desired to be able to control replacement of a consumable such as a cartridge under the environment of the office where the image forming apparatus is used.

In order to control replacement of a consumable, a door that is opened and closed to replace a consumable is provided with a locking mechanism. During normal use, the door is locked, and only when the user performs a certain operation from the control panel, the door is unlocked, so that a consumable can be replaced (U.S. Pat. No. 6,768,877). After the apparatus main body recognizes that the user has replaced the consumable with a new one, the locking mechanism is operated to lock the door. As a specific locking mechanism, a locking structure is generally known in which a lock lever having a locking claw is driven by a plunger type solenoid to lock an opening/closing door (Japanese Patent Laid-Open No. 8-2794). On the other hand, the consumable is not always replaced immediately when the door is unlocked, and some users may leave it as it is. In such a situation, the plunger type solenoid continues to be energized for a long time, which is not preferable from the viewpoint of temperature rise and power consumption.

To solve this problem, a configuration is proposed in which a plunger type solenoid and a holding type solenoid are used in combination (Japanese Patent No. 4842866). The plunger solenoid is energized and operated only when a lock lever having a locking claw is unlocked. At the unlocked position, the lock lever is held only by the force of a magnet built in the holding solenoid. The plunger of the plunger type solenoid tries to return to the original position, but the magnetic force of the magnet of the holding solenoid is large, and the lock lever is held at the unlocked position. In the case of locking again, the holding solenoid is energized, and an electromagnetic force is generated in a direction opposite to the direction of attraction by the magnetic force to return the lock lever to the locked state.

The lock mechanism of Japanese Patent No. 4842866 can reduce temperature rise and power consumption, but requires a space for disposing at least two solenoids, so that the size of the lock mechanism is increased. In addition, the cost increases accordingly.

SUMMARY OF THE INVENTION

The present invention provides a locking mechanism and an image forming apparatus that are configured to save space while reducing temperature rise and power consumption.

The present invention provides locking mechanisms and image forming apparatuses as defined in the claims.

The present invention provides a locking mechanism in which when the urging force of an urging member is larger than the magnetic force of a magnet in the non-excited state, a plunger can be held at a first position, and when the urging force of the urging member is smaller than the magnetic force of the magnet in the non-excited state, the plunger can be held at a second position.

Further features of the present invention will become apparent from the following description of exemplary embodiments with reference to the attached drawings.

DESCRIPTION OF THE EMBODIMENTS

Hereinafter, embodiments of the present invention will be described in detail by way of example with reference to the accompanying drawings. Note that the dimensions, materials, shapes, and relative arrangement of the constituent parts described in the embodiments should be appropriately changed according to the configuration of the apparatus to which the invention is applied and various conditions. That is, the scope of the present invention is not intended to be limited to the following embodiments.

First Embodiment

Overall Configuration of Image Forming Apparatus

The overall configuration of an image forming apparatus will be described. The image forming apparatus is an electrophotographic color laser printer, but is not limited thereto. The image forming apparatus may be, for example, a monochrome laser printer.

Figure 1:
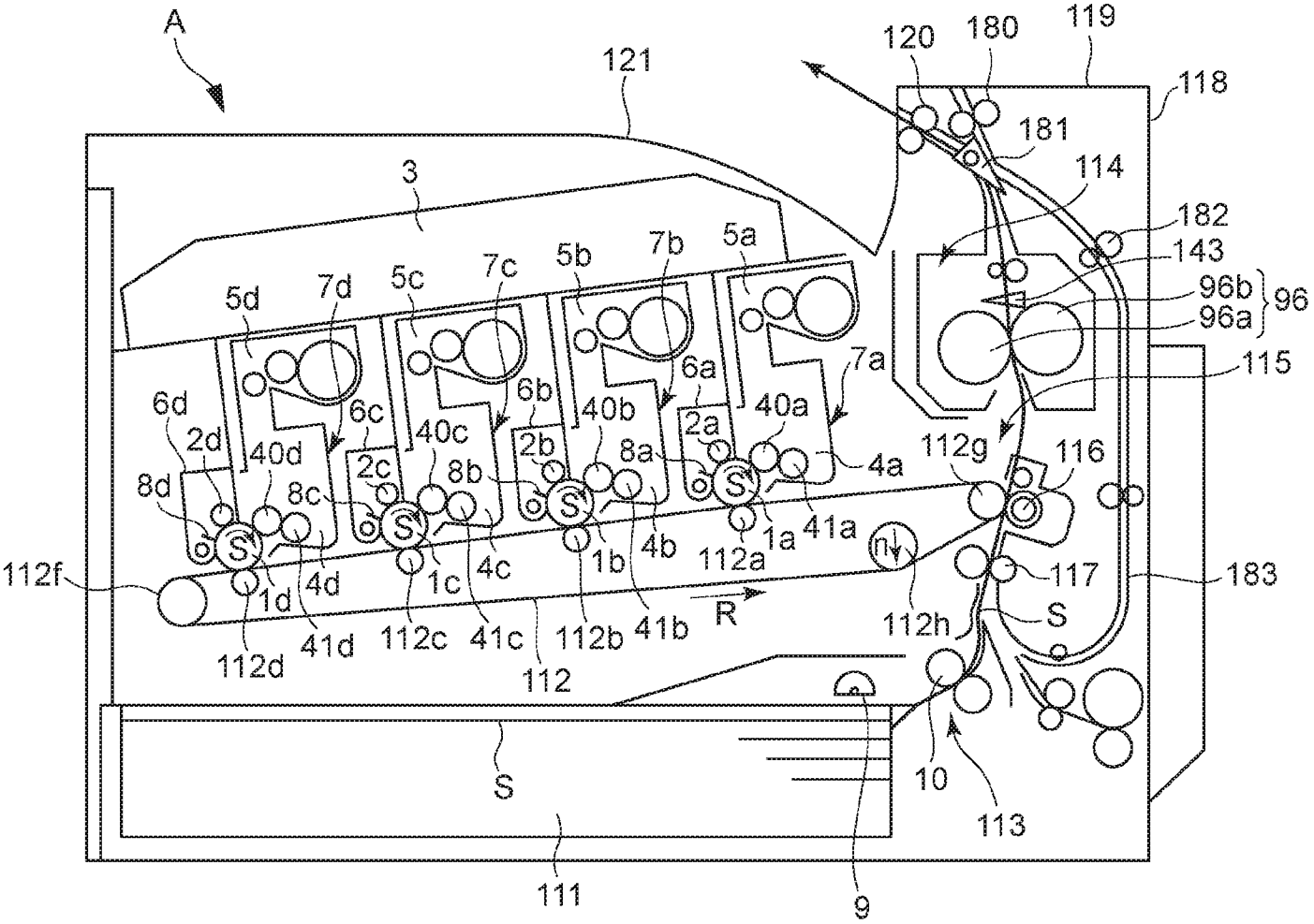
FIG. 1 is a cross-sectional explanatory view showing the configuration of an image forming apparatus.

The color image forming apparatus shown in FIG. 1 includes four process cartridges 7*a*, 7*b*, 7*c*, and 7*d* detachably attachable to a main body A of the image forming apparatus. The four process cartridges 7*a*, 7*b*, 7*c*, and 7*d* have the same structure, but contain toners of different colors, that is, yellow (Y), magenta (M), cyan (C), and black (Bk). Therefore, the process cartridges differ in that they form images of different colors. The process cartridges 7*a*, 7*b*, 7*c*, and 7*d* are composed of developing units 4*a*, 4*b*, 4*c*, and 4*d* and toner units 5*a*, 5*b*, 5*c*, and 5*d*. The developing units 4*a*, 4*b*, 4*c*, and 4*d* have photosensitive drums 1*a*, 1*b*, 1*c*, and 1*d* as image bearing members, and charging rollers 2*a*, 2*b*, 2*c*, and 2*d*. The developing units 4*a*, 4*b*, 4*c*, and 4*d* further have drum cleaning blades 8*a*, 8*b*, 8*c*, and 8*d* and waste toner containers 6*a*, 6*b*, 6*c*, and 6*d*. The developing units 4*a*, 4*b*, 4*c*, and 4*d* further have developing rollers 40*a*, 40*b*, 40*c*, and 40*d* and toner applying rollers 41*a*, 41*b*, 41*c*, and 41*d*.

A scanner unit 3 is disposed above the process cartridges 7*a*, 7*b*, 7*c*, and 7*d*, and exposes the photosensitive drums 1*a*, 1*b*, 1*c*, and 1*d* on the basis of image signals.

After the photosensitive drums 1*a*, 1*b*, 1*c*, and 1*d* are charged to a predetermined negative potential by the charging rollers 2*a*, 2*b*, 2*c*, and 2*d*, electrostatic latent images are formed by the scanner unit 3. The electrostatic latent images are reversely developed by the developing units 4*a*, 4*b*, 4*c*, and 4*d*, and toner of negative polarity is attached. The electrostatic latent images are developed, and toner images of Y, M, C, and Bk are formed.

In an intermediate transfer belt unit 112, an intermediate transfer belt 112*e* is stretched around a driving roller 112*f*, a secondary transfer opposing roller 112*g*, and a tension roller 112*h*, and the tension roller 112*h* applies tension in the direction of arrow n. Primary transfer rollers 112*a*, 112*b*, 112*c*, and 112*d* are disposed inside the intermediate transfer belt 112*e* so as to face the photosensitive drums 1*a*, 1*b*, 1*c*, and 1*d*, and a transfer bias is applied by a bias application unit.

The toner images formed on the photosensitive drums 1*a*, 1*b*, 1*c*, and 1*d* are primarily transferred onto the intermediate transfer belt 112*e*, and are conveyed to a secondary transfer unit 115 in a state in which toner images of four colors are superimposed. Here, each photosensitive drum rotates in the direction of arrow S, and the intermediate transfer belt 112*e* is rotated in the direction of arrow R. A positive bias is applied to the primary transfer rollers 112*a*, 112*b*, 112*c*, and 112*d*, and toner images are primarily transferred onto the intermediate transfer belt 112*e* in the order from the toner image on the photosensitive drum 1*a* to the toner image on the photosensitive drum 1*d*.

A feeding and conveying device 113 includes a feeding roller 9 that feeds a transfer material S from inside a sheet feeding cassette 111 that contains a transfer material (recording material) S such as paper, and a conveying roller 10 that conveys the fed transfer material S. The transfer material S conveyed from the feeding and conveying device 113 is conveyed to the secondary transfer unit 115 by a registration roller pair 117.

In the secondary transfer unit 115, a positive bias is applied to the secondary transfer roller 116, whereby a toner image of four colors on the intermediate transfer belt unit 112 is secondarily transferred to the conveyed transfer material S.

After the transfer of the toner image, the transfer material S is conveyed to a fixing device 114, and heated and pressed by a fixing roller 96*a* and a pressure roller 96*b*, and the toner image is fixed on the surface of the transfer material S. The fixed transfer material S is discharged to a sheet discharge tray 121 by a discharge roller pair 120.

In the case of double-sided printing, after the transfer material S is fixed by the fixing device 114, a double-sided flapper 181 swings downward, the transfer material S is guided to a reverse conveying path, and the conveying direction is reversed by a reversing roller 180. The transfer material S reverse-conveyed by the reversing roller 180 is conveyed in a double-sided conveying path, conveyed by a double-sided conveying roller 182, and conveyed to the transfer unit 115 and the fixing device 114 again, a toner image is also fixed on the back side, and the transfer material S is discharged to the sheet discharge tray 121.

Explanation of Locking Mechanism and Locking Operation

Figure 2:
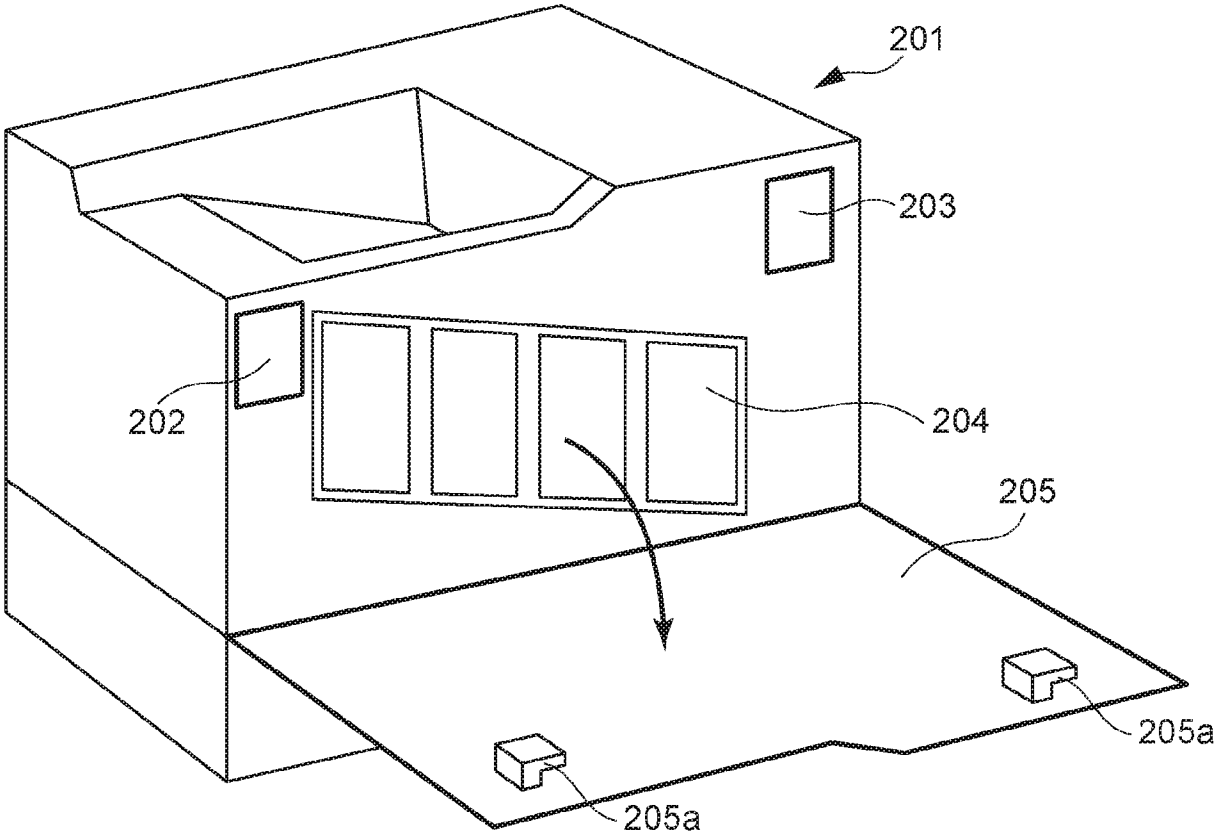
FIG. 2 is a perspective view showing a configuration of an image forming apparatus having a locking mechanism.

In a lock unit that is a locking mechanism of this embodiment, a lock unit 202 and a lock unit 203 are disposed at two left and right positions inside the main body of a printer 201 as an image forming apparatus shown in FIG. 2. On the front face of the printer 201, a door 205 (hereinafter referred to as a cartridge door) that is an openable and closable member that is opened and closed when replacing a cartridge 204 is provided. In this embodiment, the position where the cartridge door as an openable and closable member is located when the cartridge is exposed and can be seen from the outside of the image forming apparatus is referred to as the first open position. The position where the cartridge door as an openable and closable member is located when the cartridge is covered and cannot be seen from the outside of the image forming apparatus is referred to as the second closed position.

In the cartridge door 205, which is an openable and closable member, latch portions 205*a* are provided at two places in total, one for each lock unit (the lock unit 202 and the lock unit 203).

Figure 3:
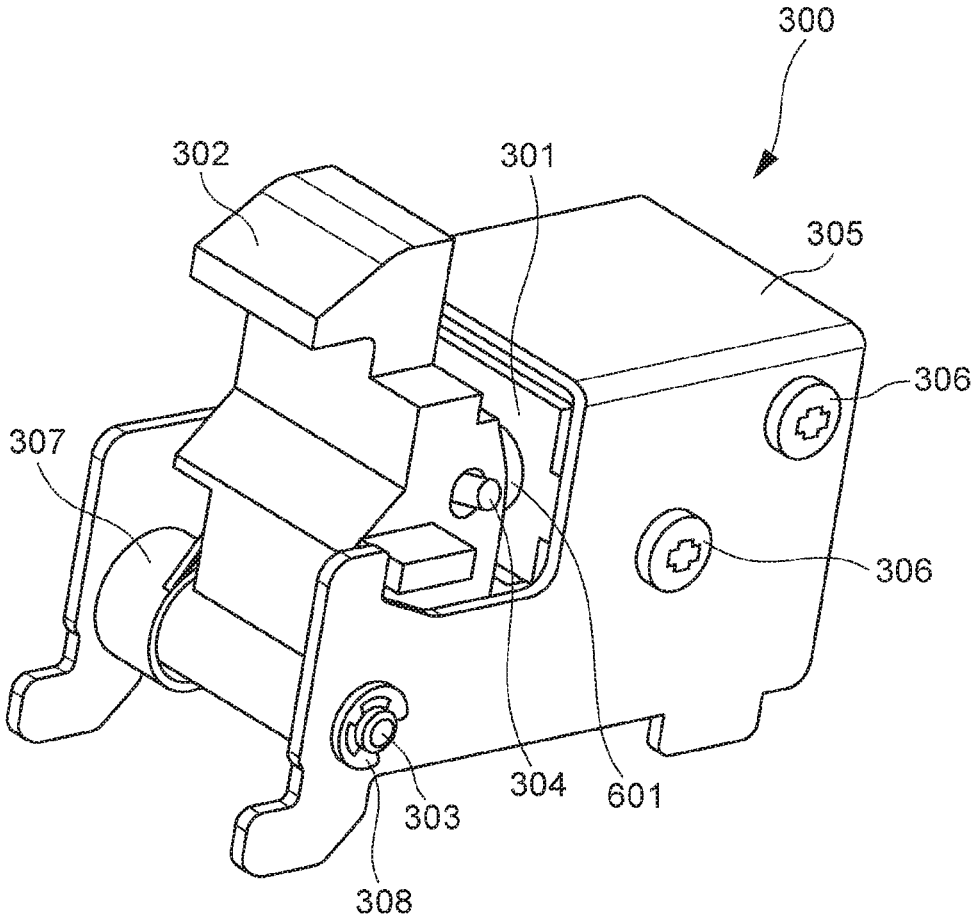
FIG. 3 is a perspective view of a lock unit according to a first embodiment.

FIG. 3 shows a lock unit 300 that is a locking mechanism of this embodiment. The lock unit 300 has a holding solenoid 301 with a built-in permanent magnet, a lock lever 302 as a locking member, and a rotary shaft 303 of the lock lever. In addition, the lock unit 300 has a pin 304 that connects (engages) a plunger 601 of the holding solenoid 301 with the lock lever 302, which is a locking member, and a lock holder 305 made of sheet metal. Further, the lock unit 300 has screws 306 for fastening the lock holder 305 and the holding solenoid 301, a spring 307 for urging the lock lever 302, and an E ring 308 for retaining the lock lever shaft.

Figure 4:
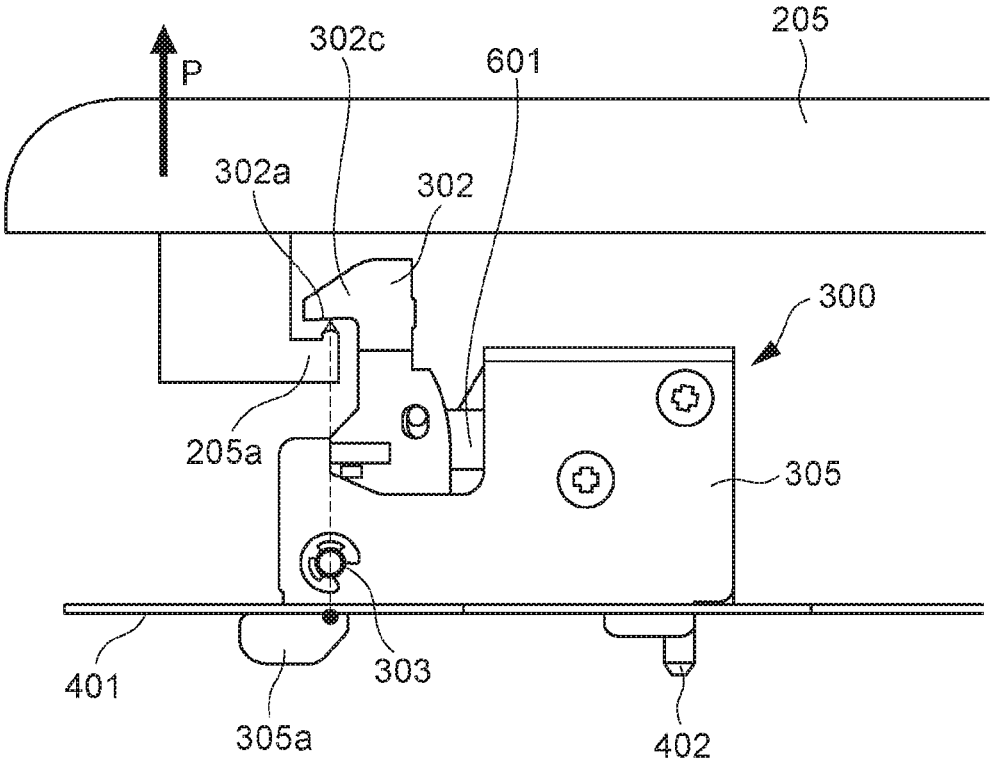
FIG. 4 is a cross-sectional view at the time of locking in the state in which the lock unit according to the first embodiment is attached to the main body of the image forming apparatus.

FIG. 4 shows a state in which the lock unit is attached to the main body of the image forming apparatus. In the lock unit 300, a hook portion 305*a* of the lock holder 305 is hooked on a main body frame 401 of the image forming apparatus, and another bent portion (not shown) is fixed with a screw 402. By providing the rotary shaft 303 of the lock lever in the vicinity of the hook portion 305*a* of the lock holder, the force transmission is substantially in a straight line as indicated by the dotted arrow in FIG. 4. Therefore, the opening force of the cartridge door received by the lock lever 302 from the latch portion 205*a* can be received by the hook portion 305*a* of the lock holder 305 via the lock lever 302, and a large force can be withstood.

A surface 302*a* of the locking claw 302*c* of the lock lever 302 is held at a position where it is engaged with the latch portion 205*a* of the cartridge door. Therefore, if one attempts to open the cartridge door 205 in the P direction, the surface 302*a* of the locking claw 302*c* contacts the latch portion 205*a*, and the cartridge door 205 does not open any more.

Figure 5:
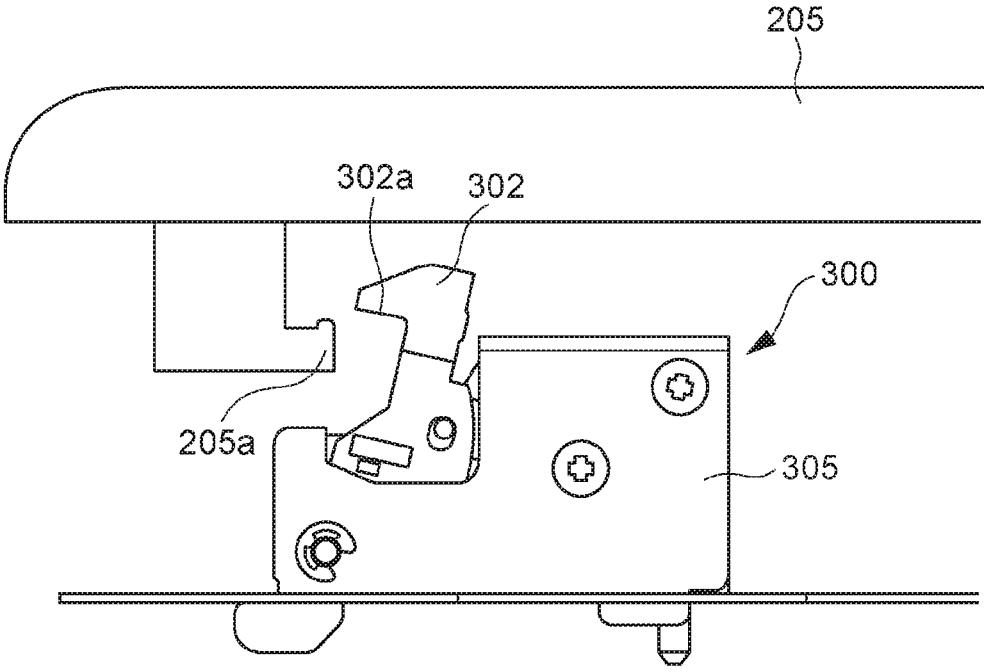
FIG. 5 is a cross-sectional view at the time of unlocking in the state in which the lock unit according to the first embodiment is attached to the main body of the image forming apparatus.

FIG. 5 shows a state in which the lock unit 300 is unlocked. Since the lock lever 302 rotates to the position where the surface 302*a* of the locking claw 302*c* is retracted from the latch portion 205*a*, the cartridge door 205 can be freely opened and closed.

Next, the timing at which the lock unit operates will be described. During normal use, the cartridge door is locked and cannot be opened. When the remaining amount of toner in the cartridge becomes small and the predetermined replacement timing comes, the printer automatically unlocks the lock and informs the user that it is time to replace the cartridge. After opening the cartridge door and replacing the cartridge with a new cartridge, the user closes the cartridge door. After the printer recognizes that the cartridge has been replaced with a new cartridge, the lock automatically returns to the locked state.

In this embodiment, the lock is automatically unlocked when the remaining amount of toner in the cartridge becomes small. However, it suffices that replacement of a consumable such as a cartridge can be controlled. For example, the lock may be unlocked after the user inputs a predetermined code or the like through the control panel or the like.

Relationship Between Forces in Locking Mechanism

The relationship between forces in the locking mechanism will be described. In the locking mechanism of this embodiment, the plunger of the holding solenoid is movable between a locked position (first position) and an unlocked position (second position). A direction from the second position to the first position is referred to as a first direction, and a direction from the first position to the second position is referred to as a second direction. That is, the direction opposite to the first direction is the second direction. In this embodiment, the locked position is the first position and the unlocked position is the second position, but this relationship may be reversed. That is, the locked position may be the second position, and the unlocked position may be the first position.

Figure 6A:
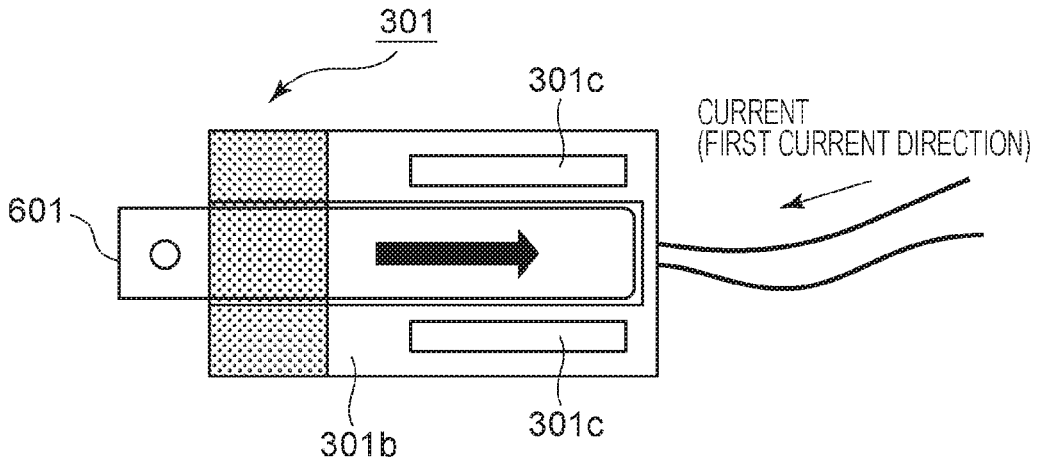
FIGS. 6A and 6B are explanatory views of a holding solenoid.

Hereinafter, the relationship between forces at the two positions of the locked position (the first position) and the unlocked position (the second position) in the non-energized state (non-excited state) will be described. First, the holding solenoid will be described with reference to FIGS. 6A and 6B. The holding solenoid 301 has a coil 301*b*, and the coil 301*b* can be bi-directionally energized. When the current flows in the first current direction as shown in FIG. 6A, an electromagnetic force in a direction in which the plunger 601 is retracted into the holding solenoid 301 is generated from the coil 301*b*. Therefore, the plunger 601 moves in the second direction and moves to the second position in the holding solenoid 301.

Figure 6B:
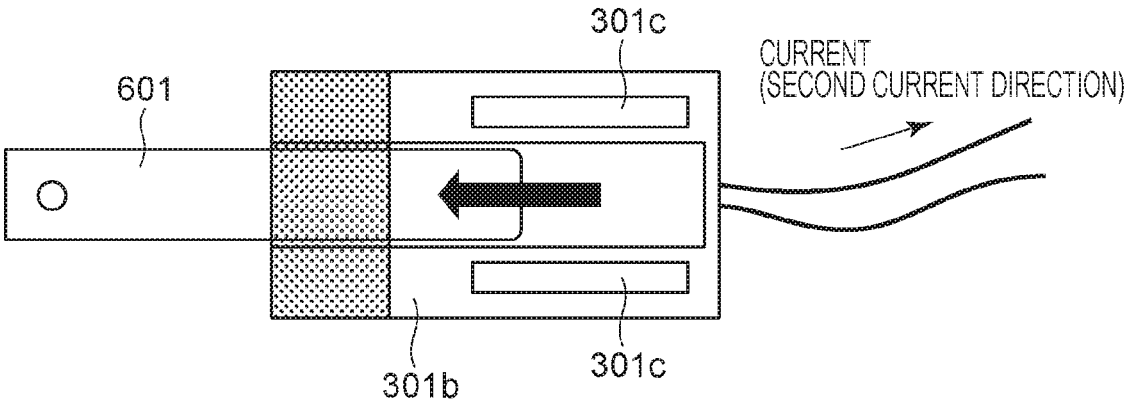

On the other hand, when the current flows in the direction (the second current direction) opposite to the first current direction as shown in FIG. 6B, an electromagnetic force in the direction in which the plunger 601 is extruded is generated from the coil. Therefore, the plunger 601 moves in the first direction and moves to the first position where it protrudes outward from the holding solenoid 301.

The holding solenoid has a built-in permanent magnet 301*c*. In the non-energized state (non-excited state), a force is always applied in a direction (second direction) in which the plunger is retracted by the magnetic force of the permanent magnet 301*c*. Therefore, with the holding solenoid alone, it is impossible to maintain the state of FIG. 6B in which the plunger 601 is at the first position. Therefore, in this embodiment, in order to maintain the state of FIG. 6B in which the plunger 601 is at the first position, a spring that is an urging member is used.

Figure 7:
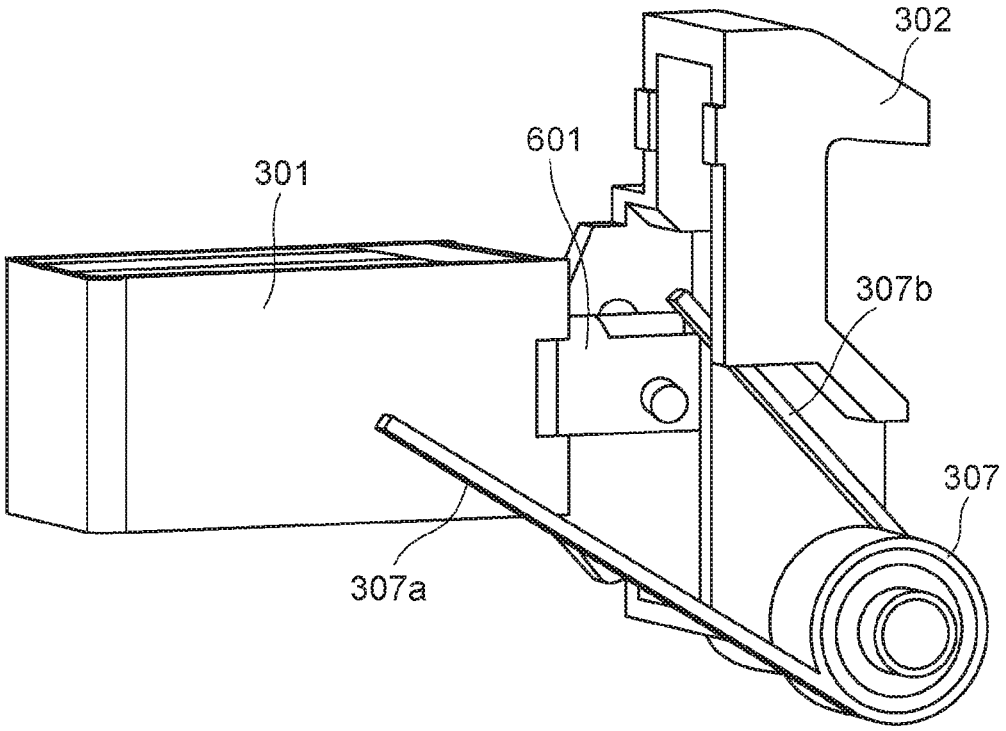
FIG. 7 is a detailed explanatory view of the internal components of the lock unit according to the first embodiment.

FIG. 7 shows a mounted state of a spring as an urging member. The spring 307 of this embodiment is a torsion spring, the fixed end 307*a* is fixed to the lock holder 305, and the free end 307*b* is fixed to the lock lever 302. The lock lever is urged in the locking direction by the spring force of the spring as an urging member. When the spring force in the first direction is stronger than the magnetic force in the second direction by the magnet of the holding solenoid 301, the plunger 601 can be held in the locked state at the first position, which is the locked position, in the non-energized state (non-excited state).

In order to perform all operations with only one holding solenoid and one spring, it is necessary that the lock lever is operable in the energized state and the lock lever can be held at two positions in the non-energized state. For that purpose, it is necessary to set the spring pressure F of the spring as follows.

Figure 8:
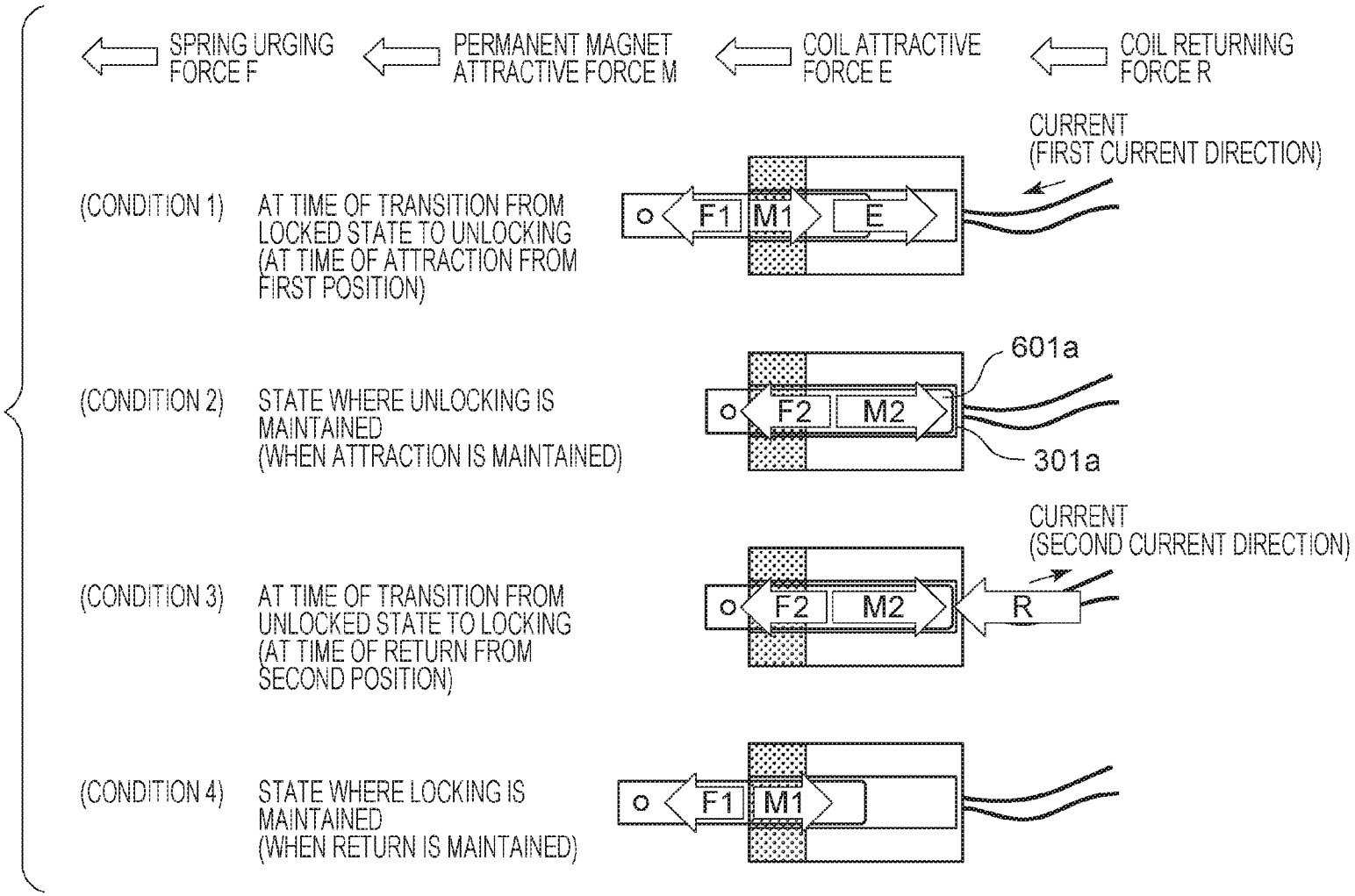
FIG. 8 is an explanatory view showing the relationship between forces of a holding solenoid and a spring.

The relationship between forces is shown in FIG. 8. In order to explain only the relationship between forces, depiction of the lock lever, the spring etc. is omitted, and only the forces acting on the plunger of the holding solenoid are indicated by arrows. In FIG. 8, it is assumed that when the plunger 601 is at the first position, the lock lever is at the locked position, and when the plunger 601 is at the second position, the lock lever is at the unlocked position.

Each force is defined as follows. First, the urging force with which the spring as an urging member urges the lock lever as a locking member in the locking direction, which is the first direction, is denoted by F. The permanent magnet attractive force in the second direction by the magnet of the holding solenoid is denoted by M. The coil attractive force generated from the coil by energization in the first current direction in order to move the plunger of the holding solenoid in the first direction is denoted by E. The returning force generated from the coil by energization in the direction (second current direction) opposite to the first current direction in order to move the plunger of the holding solenoid in the second direction is denoted by R.

The urging force in the first direction with which the spring as an urging member urges the lock lever as a locking member when the plunger is at the first position (the locked state where the locking member locks the cartridge door) is denoted by F1. The urging force in the first direction with which the spring as an urging member urges the lock lever as a locking member when the plunger is at the second position (the unlocked state where the locking between the locking member and the cartridge door is released) is denoted by F2. The permanent magnet attractive force in the second direction acting on the plunger from the magnet when the plunger is at the first position is denoted by M1, and the permanent magnet attractive force in the second direction acting on the plunger from the magnet when the plunger is at the second position is denoted by M2.

In this case, it is necessary to satisfy the following Conditions 2 and 4.

$F1<M1+E$ Condition 1

$F2<M2$ Condition 2

$F2+R>M2$ Condition 3

$F1>M1$ Condition 4

That is, Condition 2 is a condition for holding the plunger at the second position without excitation when the plunger is at the second position. Condition 4 is a condition for holding the plunger at the first position without excitation when the plunger is at the first position.

By satisfying this condition, even when the plunger is located at the first position or the second position, it is possible to hold the plunger in a non-energized state (non-excited state).

Conditions 1 and 3 are conditions under which the plunger can move in the energized state (excited state). In the present invention, it is important to hold the plunger in the non-excited state, and a configuration achieving this is disclosed, and it is sufficient to satisfy at least Condition 2 and Condition 4.

Further, each condition will be explained.

Condition 1 is a condition under which the lock lever, which is a locking member, transits from the locked state where the cartridge door as an openable and closable member is locked to the unlocked state where the cartridge door is unlocked. At this time, a current flows through the coil of the holding solenoid in the first current direction, and the coil attractive force E is generated in the second direction. The sum of the coil attractive force E and the permanent magnet attractive force M1 of the magnet in the same direction as the second direction becomes larger than the urging force F1 in the first direction, so that the state transition can be made.

Condition 2 is a condition under which the unlocked state where the locking between the lock lever as a locking member and the cartridge door is released is maintained in the non-energized (non-excited) state. In this embodiment, the plunger of the holding solenoid is held at the second position. In the unlocked state, the plunger tip 601*a* contacts a main body bottom portion 301*a* of the holding solenoid and is close to the permanent magnet, so a strong magnetic force is generated. For this reason, the permanent magnet attractive force M2 is larger than the permanent magnet attractive force M1. When the urging force F2 in the first direction of the spring as an urging member is smaller than the permanent magnet attractive force M2 in the second direction, the unlocked state in which the plunger is at the second position where the plunger contacts the main body bottom portion 301*a* of the holding solenoid can be maintained. In this embodiment, the state in which the plunger contacts the main body bottom portion 301*a* of the holding solenoid is the second position of the plunger, but the present invention is not limited thereto.

Condition 3 is a condition under which the lock lever, which is a locking member, transits from the unlocked state to the locked state where it locks the openable and closable member. At this time, the coil returning force R in the first direction due to energization in the second current direction is generated in the coil of the holding solenoid. The sum of the coil returning force R and the urging force F2 in the same direction as the first direction becomes larger than the permanent magnet attractive force M1 in the second direction, so that the state transition can be made.

Condition 4 is a condition under which the locked state where the lock lever as a locking member locks the openable and closable member is maintained in the non-energized (non-excited) state. At this time, since the urging force F1 in the first direction is larger than the permanent magnet attractive force M1 in the second direction, the locked state can be maintained. Condition 4 in this embodiment is a condition under which a state where the plunger is at the first position is maintained.

In the above, the state in which the plunger is retracted is maintained by the magnetic force (Condition 2), and the state in which the plunger is extruded is maintained by the spring force (Condition 4), but the present invention is not limited thereto.

Figure 16:
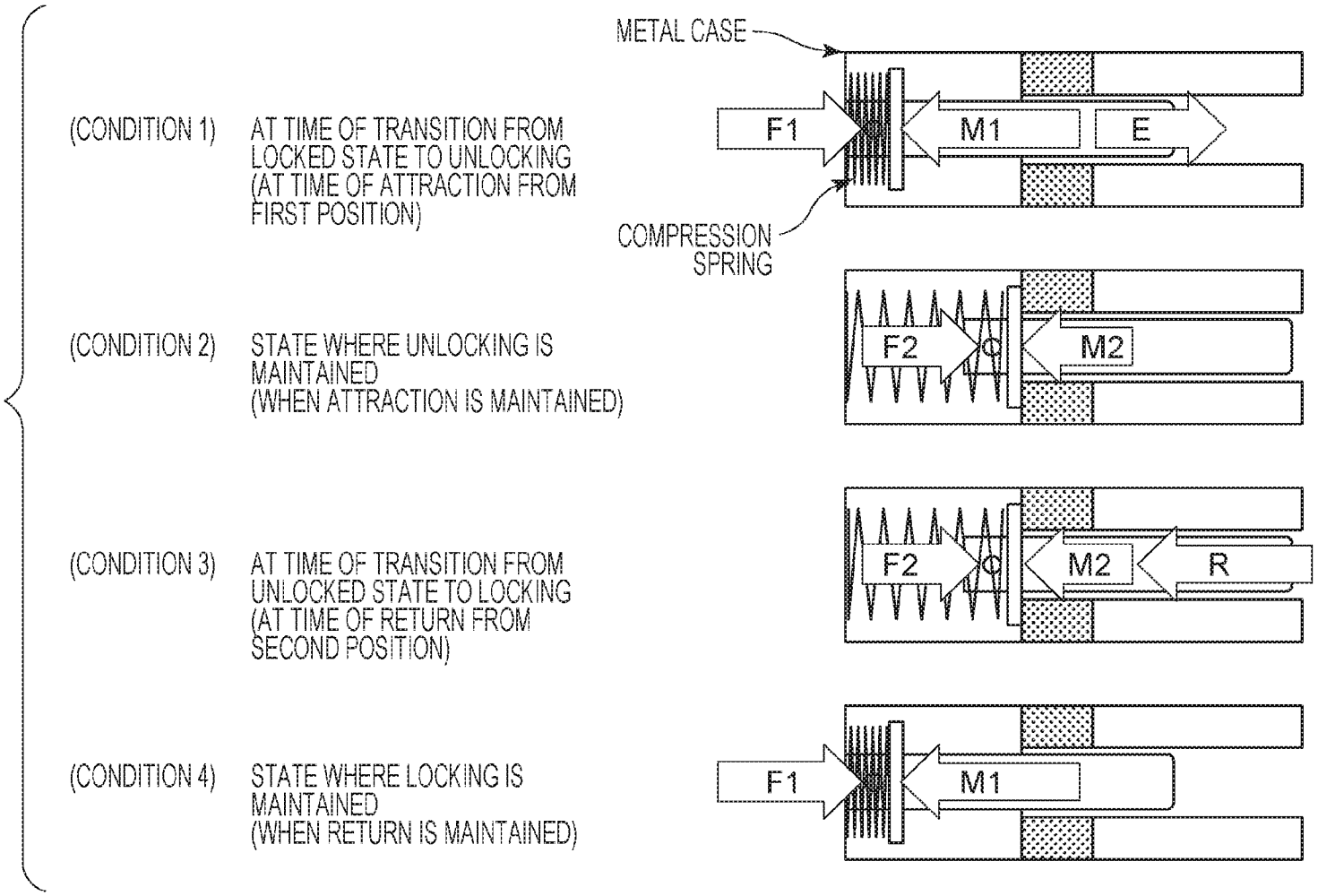
FIG. 16 is an explanatory view showing a modification example of the first embodiment.

For example, as shown in FIG. 16, the holding solenoid main body may not have the main body bottom portion 301*a*, the plunger tip 601*a* may not contact the holding solenoid main body at the second position, and the plunger may contact the holding solenoid main body after the plunger moves to the first position. As shown in FIG. 16, the state in which the plunger is retracted (Condition 2) is maintained by the spring force, and the state in which the plunger is extruded (Condition 4) is maintained by the magnetic force.

In this case, the relationship between forces is as follows.

$F1+E>M1$ Condition 1

$F2>M2$ Condition 2

$F2<M2+R$ Condition 3

$F1<M1$ Condition 4

Here, each force is as follows. F1 is a force with which the spring as an urging member urges the locking member in the second direction when the plunger is at the first position. F2 is a force with which the spring as an urging member urges the locking member in the second direction when the plunger is at the second position. M1 is a force in the first direction received from the magnet when the plunger is at the first position. M2 is a force in the first direction received from the magnet when the plunger is at the second position. E is a force generated in the coil to move the plunger in the second direction. R is a force generated in the coil to move the plunger in the first direction.

How Lock Lever Claw Portion and Cartridge Door Latch Portion Receive Force

Figure 9:
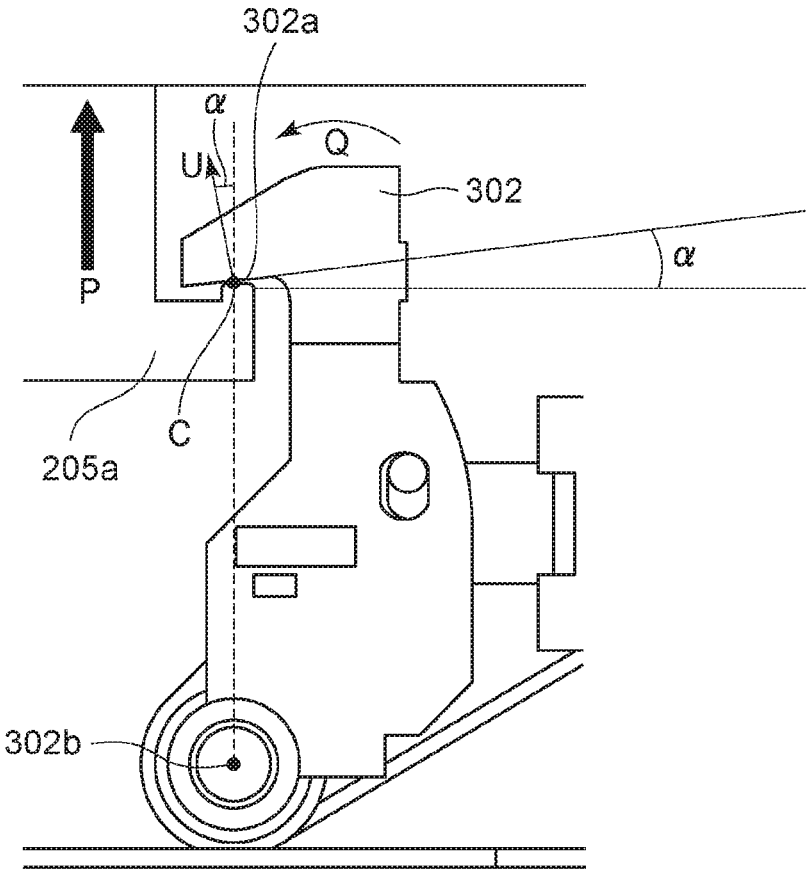
FIG. 9 is a detailed explanatory view of a lock lever claw portion of the first embodiment.

FIG. 9 shows the state of the lock lever as a locking member and the cartridge door as an openable and closable member under Condition 4. When the latch portion 205*a* of the cartridge door is pulled in the P direction, a rotational force in the Q direction is generated in the lock lever 302, and the lock lever claw portion bites into the latch portion 205*a*. Specifically, there is a contact point C (a contact point between the latch portion 205*a* and the surface 302*a* of the lock lever claw portion) on the extension line in the P direction (the opening direction of the cartridge door) from the rotation center 302*b* of the lock lever 302. The surface 302*a* of the lock lever claw portion is provided with an inclination of a degrees with respect to the surface of the cartridge door in a state where the openable and closable cartridge door is closed. Looking from a different viewpoint, the surface 302*a* of the lock lever claw portion is provided with an inclination of a degrees with respect to the straight line connecting the rotation center of the lock lever and the contact point.

With such a configuration, even if the user tries to open the cartridge door, the force U input from the contact point C to the lock lever 302 acts in a direction inclined by an angle α with respect to the P direction, so that the lock lever can maintain the locked state.

Manual Unlocking

Figure 10:
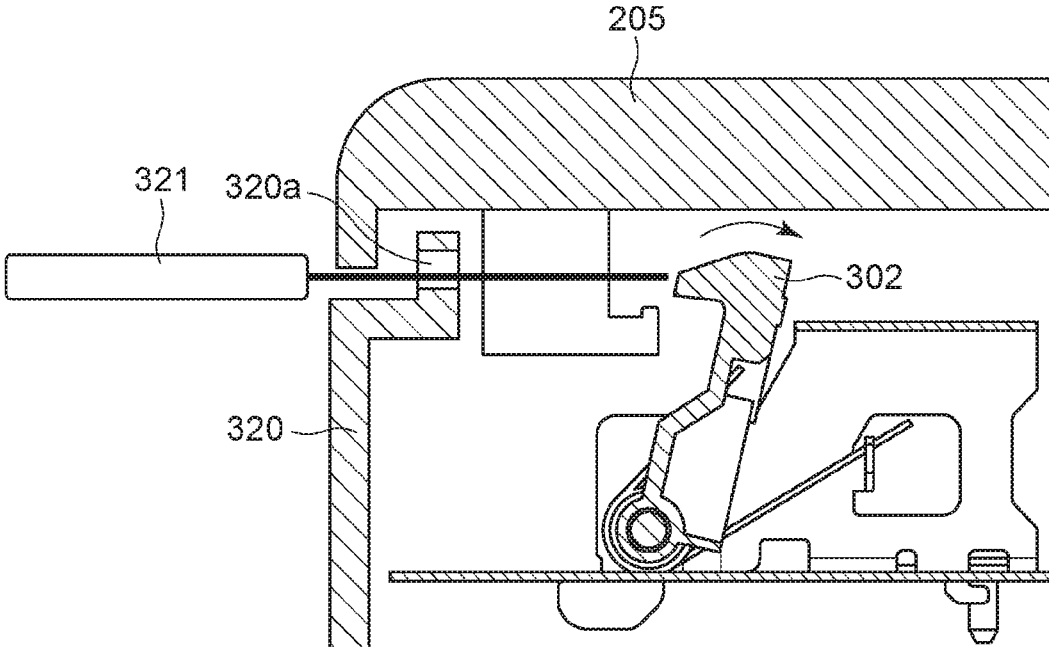
FIG. 10 is a cross-sectional explanatory view of manual unlocking according to the first embodiment.

The manual unlocking will be described with reference to FIG. 10. When the holding solenoid, the electric parts, etc. fail, and the lock unit does not operate, the cartridge door will not open. As a countermeasure against such a case, manual unlocking can be performed. Specifically, a small hole 320*a* is opened in the left cover 320. When performing manual unlocking, the tip of a bar-shaped tool 321 is inserted into the hole 320*a*. Since there is the lock lever 302 on the extension line of the hole 320*a*, when the tool is further pushed, the lock lever rotates in the direction of the arrow in FIG. 10, and the lock is unlocked. Since the hole 320*a* of the left cover is covered when the cartridge door is closed, the hole 320*a* is hard to see from the outside. That is, it is necessary to slightly raise the cartridge door so that the bar-like tool 321 can be inserted into the hole 320*a*.

The configuration described here is an example, and the manual unlocking method is not limited to this. For example, when a cover that can be opened and closed independently of the cartridge door exists, the cover may be opened, the lock lever may be operated from the inside of the apparatus body, and the lock may be unlocked.

Shielding of Magnetic Field from Holding Solenoid

A magnetic field is constantly generated from the permanent magnet 301*c* of the holding solenoid. When the coil is energized, a magnetic field by the electromagnet is also generated. For this reason, when a holding solenoid is placed in the vicinity of the cover of the main body of the apparatus as in this embodiment, it may be necessary to shield the magnetic field.

As shown in FIG. 3, although the holding solenoid 301 is covered with the lock holder 305 made of iron, the magnetic field leaks from the gap between the lock lever 302 and the lock holder 305. Since the lock lever moves between the locked position and the unlocked position, this gap cannot be covered with the lock holder.

Therefore, in this embodiment, the magnetic field is shielded by providing the cartridge door with a shield plate.

Figure 17:
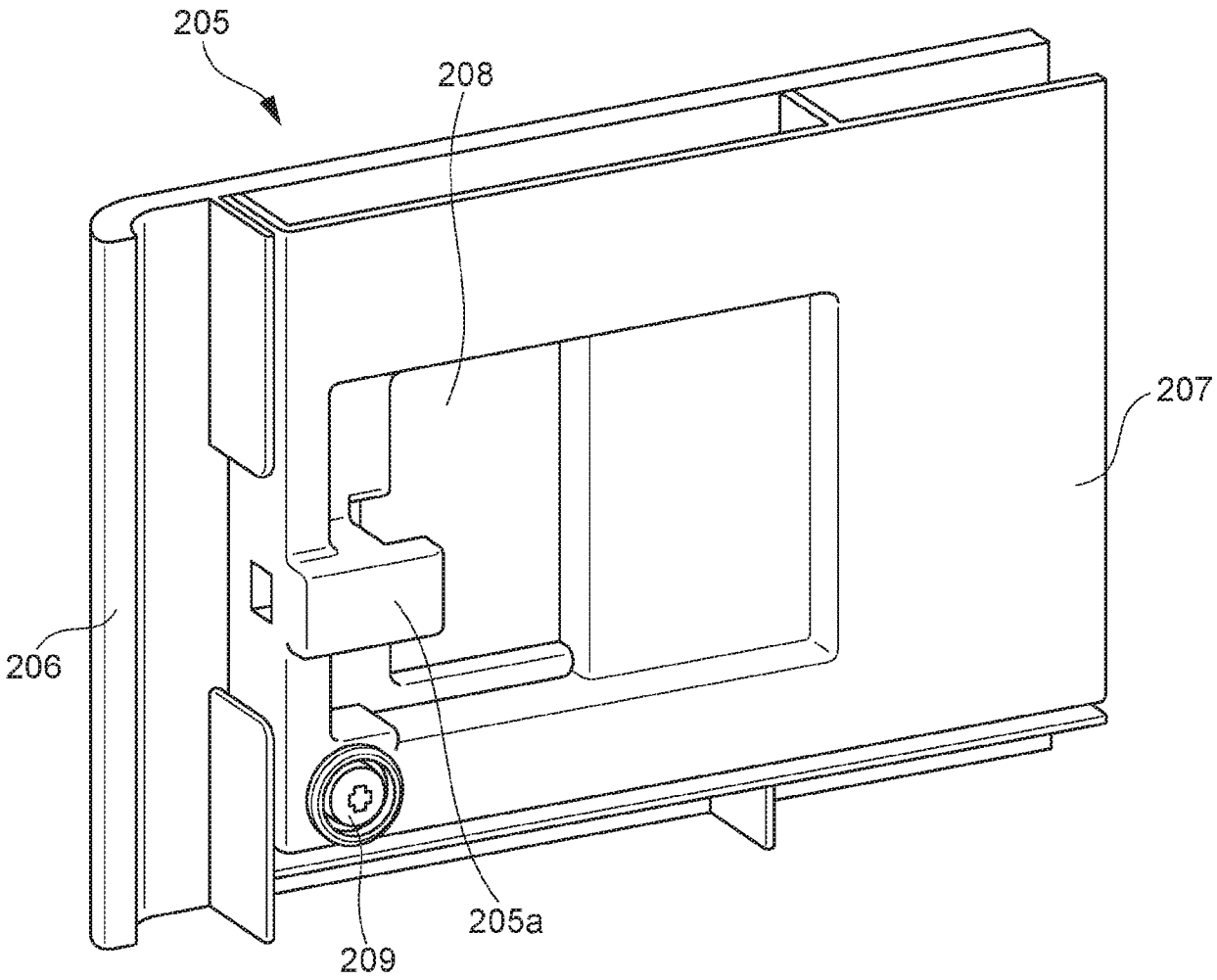
FIG. 17 is a detailed explanatory view of the inside of the cartridge door of the first embodiment.

FIG. 17 shows a detailed view of the inner side of a part of the cartridge door.

The cartridge door 205 is constructed by fixing a shield plate 208 between a door outer cover 206 and a door inner cover 207 with a plurality of screws 209 (only one of them is shown).

Figure 18:
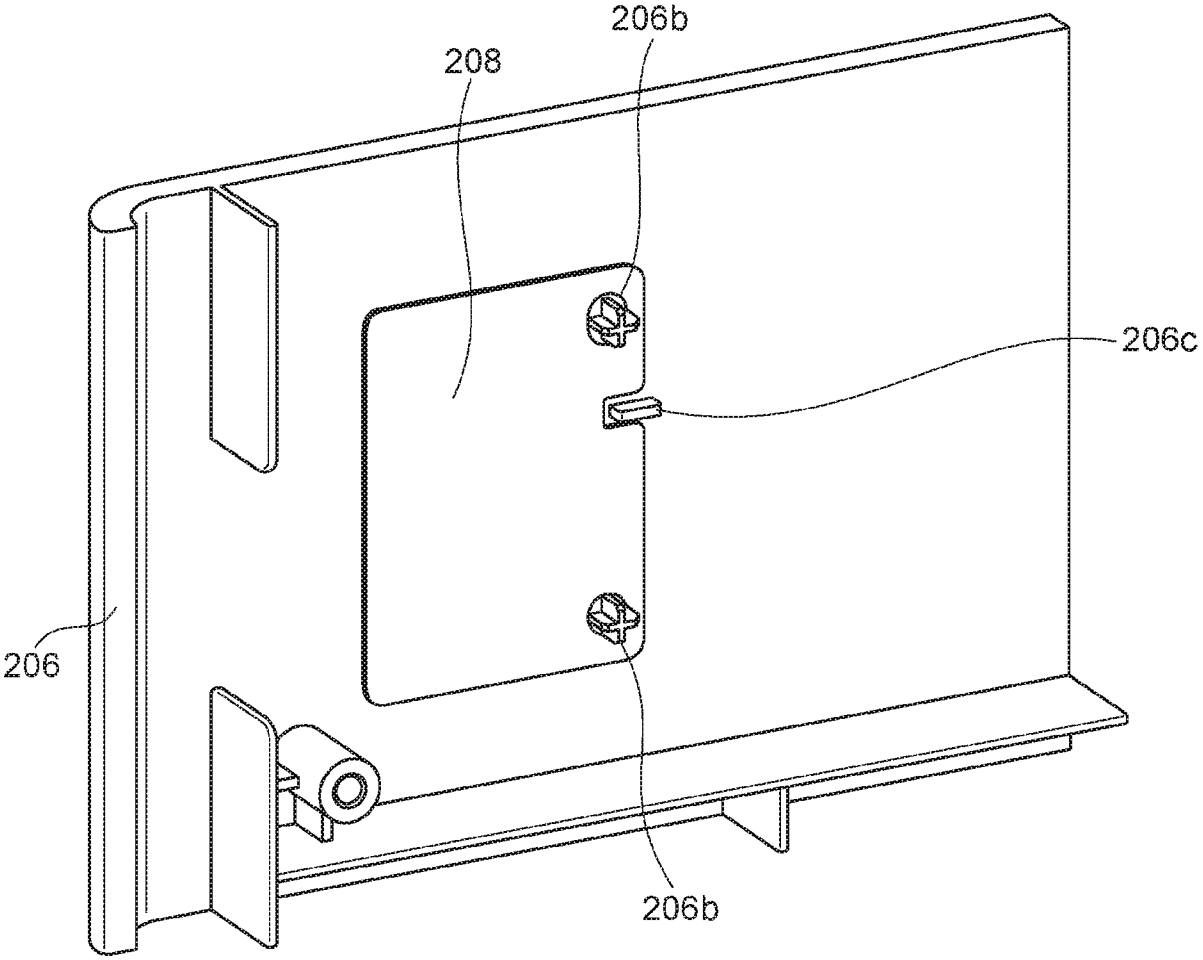
FIG. 18 is an explanatory view showing a disassembled state of the cartridge door of the first embodiment.

FIG. 18 shows the cartridge door with the door inner cover removed. The shield plate 208 is positioned by two positioning bosses 206*b* of the door outer cover 206. Further, for preventing erroneous assembly, a misassembly prevention rib 206*c* is provided.

Figure 19:
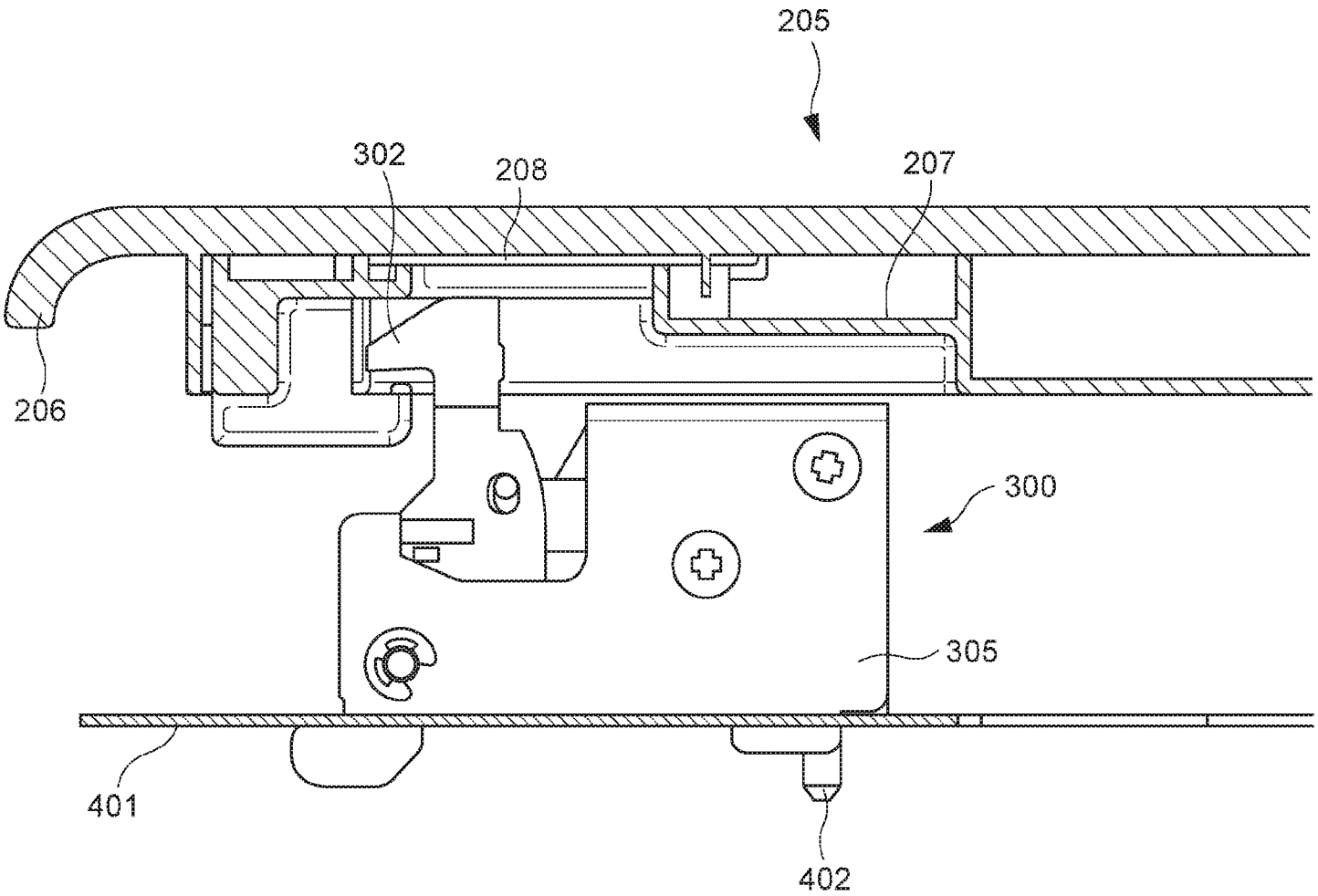
FIG. 19 is an explanatory view showing the relationship between the cartridge door with a shield plate and the lock unit of the first embodiment.

For reference, FIG. 19 shows the relationship between the cartridge door 205 including the shield plate 208 and the lock unit 300.

In this embodiment, the shield plate 208 is made of iron and has a thickness of 0.4 mm and a size of 40 mm×30 mm. The thickness, size, material, and position of the shield plate may be different from those of this embodiment as long as it is sufficient to absorb the magnetic flux. For example, the magnetic flux may be shielded by attaching a shield plate as a nameplate to a recessed portion provided on the external surface of the door outer cover 206, or the magnetic flux may be shielded while giving a luxurious appearance by forming the door outer cover 206 itself of an iron sheet metal.

In this embodiment, as shown in FIG. 2, when the cartridge door is in the open state, the cartridge door interferes and the user cannot approach the lock unit. With this configuration, it is possible to prevent the user from being affected by the magnetic field from the holding solenoid even when the openable and closable member is opened.

Other

In this embodiment, locking of a cartridge door provided so as to be openable and closable in a main body of an image forming apparatus for attaching and detaching a cartridge and provided so as to be movable between the first open position and the second closed position has been described, but another object may be locked. For example, the object may be not only an openable and closable member such as a cartridge door but also a moving member such as a cartridge tray holding a cartridge. The locking mechanism may lock the sliding movement of a moving member such as a cartridge tray.

Second Embodiment

This embodiment will describe an image forming apparatus employing a shield plate having a configuration different from that of the first embodiment with respect to the shielding of the magnetic field from the holding solenoid described in the first embodiment. The same reference numerals or the same member names, even if reference numerals are different, are attached to components configured in the same manner as in the first embodiment, and the description thereof will be omitted.

Figure 20:
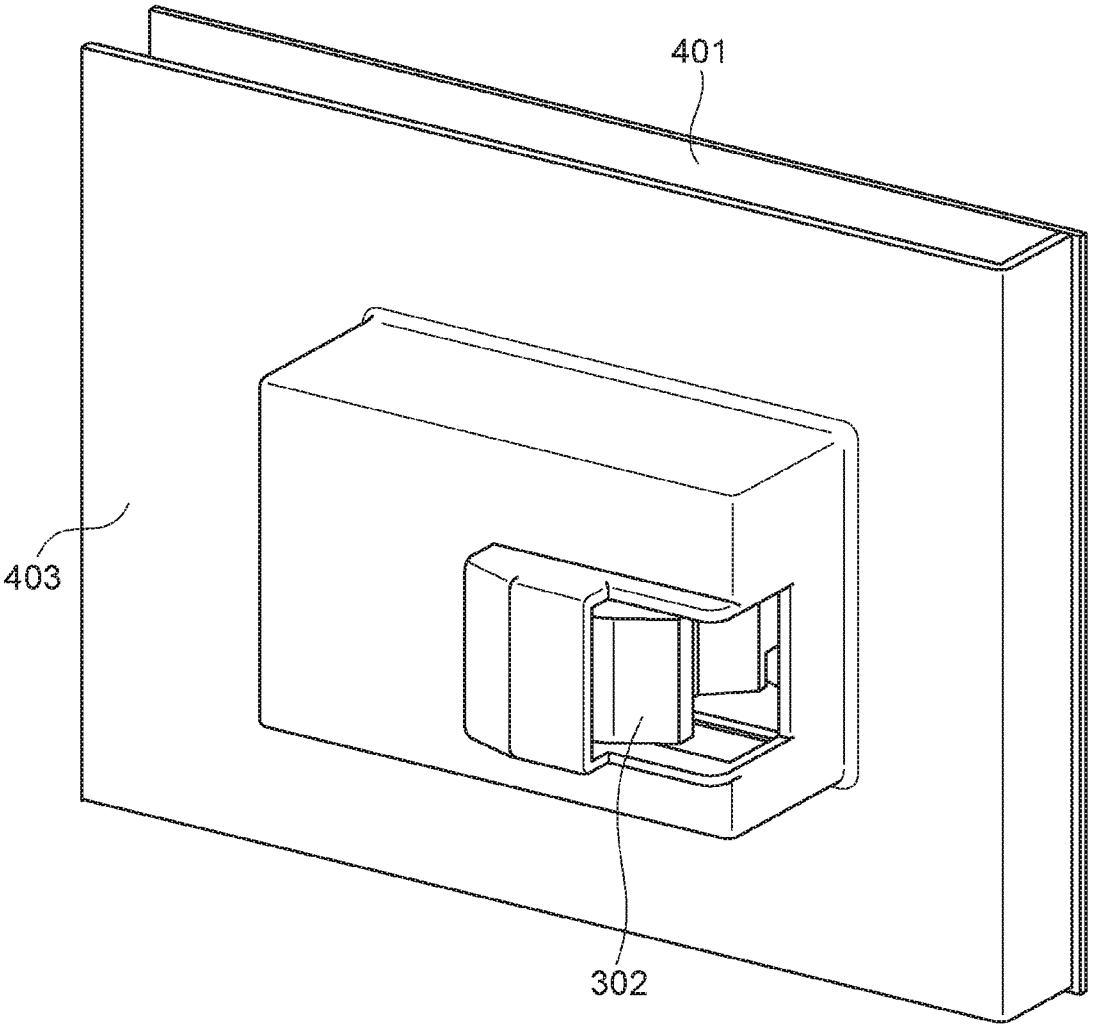
FIG. 20 is an explanatory view showing a lock unit according to a second embodiment and its surrounding with a cover attached.

FIG. 20 is a perspective view of the lock unit placed in the apparatus main body. The lock unit is placed in the apparatus body frame 401 as in the first embodiment. In this embodiment, a lock unit cover 403 covering the lock unit, which is omitted in the first embodiment, is also depicted. A part of the lock lever 302 can be seen through a hole of the lock unit cover (although in FIG. 20, the lock lever is shown in the locked position for the sake of explanation, the lock lever is normally located at the unlocked position in the state where the cartridge door is open).

Figure 21:
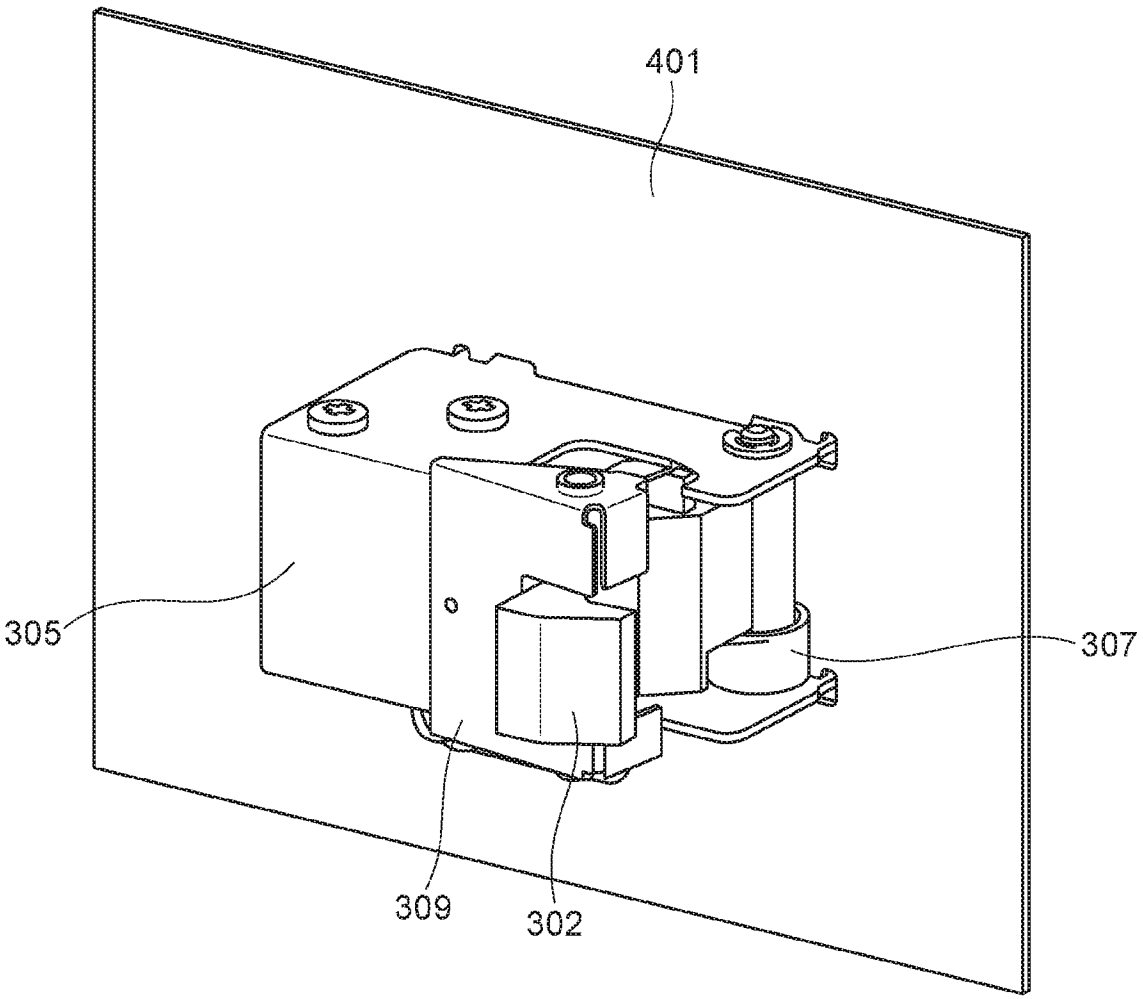
FIG. 21 is an explanatory view showing the lock unit according to the second embodiment and its surrounding with the cover removed.

FIG. 21 is a perspective view in which the lock unit cover 403 is omitted. In the lock unit of this embodiment, a swinging shield plate 309 made of iron, which is swingably supported by the lock lever 302, is placed in order to shield the magnetic field emitted from the holding solenoid. In addition, an iron-based sintered metal, which is a ferromagnetic material, is used as a material of the lock lever 302 (in the first embodiment, since the lock lever is not required to be made of a ferromagnetic material, it can be made of resin). If the magnetic field emitted from the solenoid is sufficiently shielded, the surface of the lock lever may be coated with nickel, which is a ferromagnetic material, or an iron sheet metal may be placed on a part of the lock lever for shielding. Further, if the outside of the apparatus can be shielded from the magnetic field by the lock holder 305 and the swinging shield plate 309, the lock lever 302 may be made of resin.

Figure 22A:
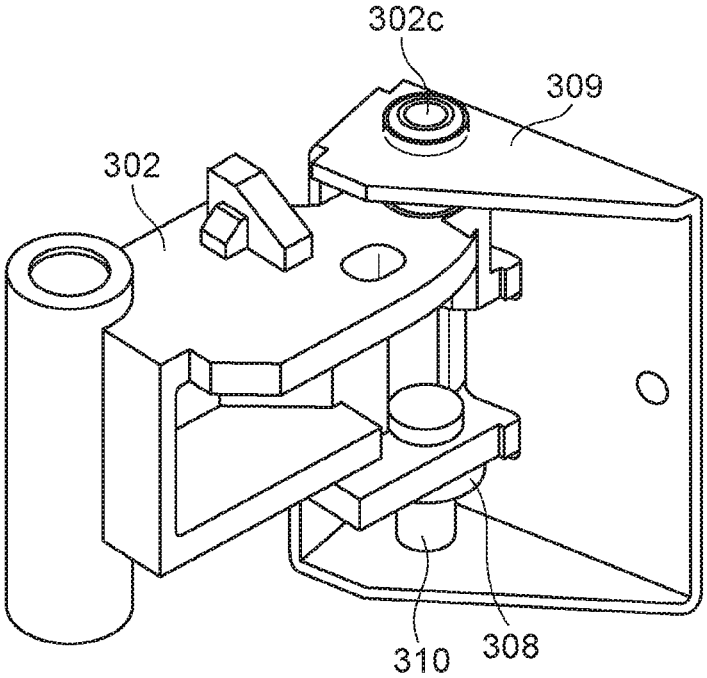
FIGS. 22A and 22B are explanatory views showing the lock lever and the shield plate of the second embodiment.
Figure 22B:
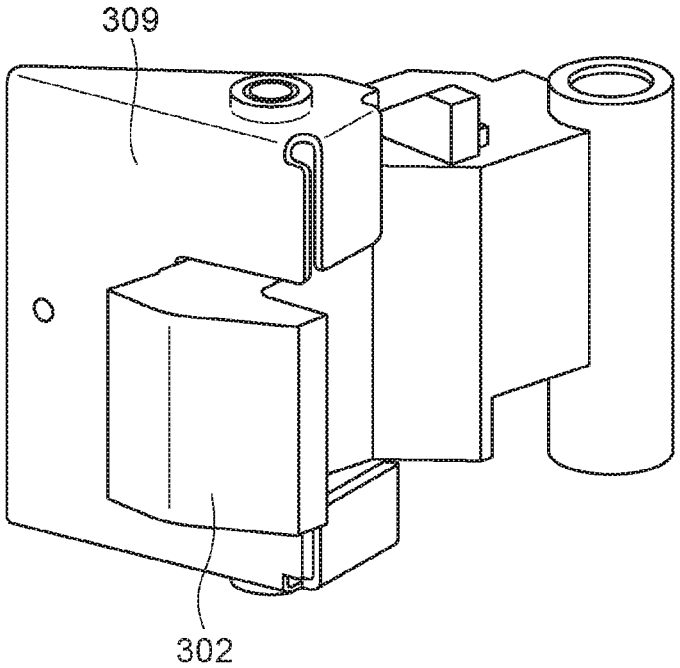

Next, the configuration of the lock lever 302 and the swinging shield plate 309 will be described with reference to FIGS. 22A and 22B. FIGS. 22A and 22B are perspective views seen from different directions. The swinging shield plate 309 is supported swingably about the cylindrical boss 302*c* of the lock lever 302 and the rotary shaft 310. In assembling the lock lever 302 and the swinging shield plate 309, after inserting the cylindrical boss 302*c* into a hole of the swinging shield plate 309, the rotary shaft 310 is inserted from the inside of the lock lever into the other hole of the swinging shield plate, and an E-ring 308 is fixed to prevent the rotary shaft 310 from coming off.

Next, the movement of the swinging shield plate 309 will be described with reference to FIGS. 23 and 24.

Figure 23:
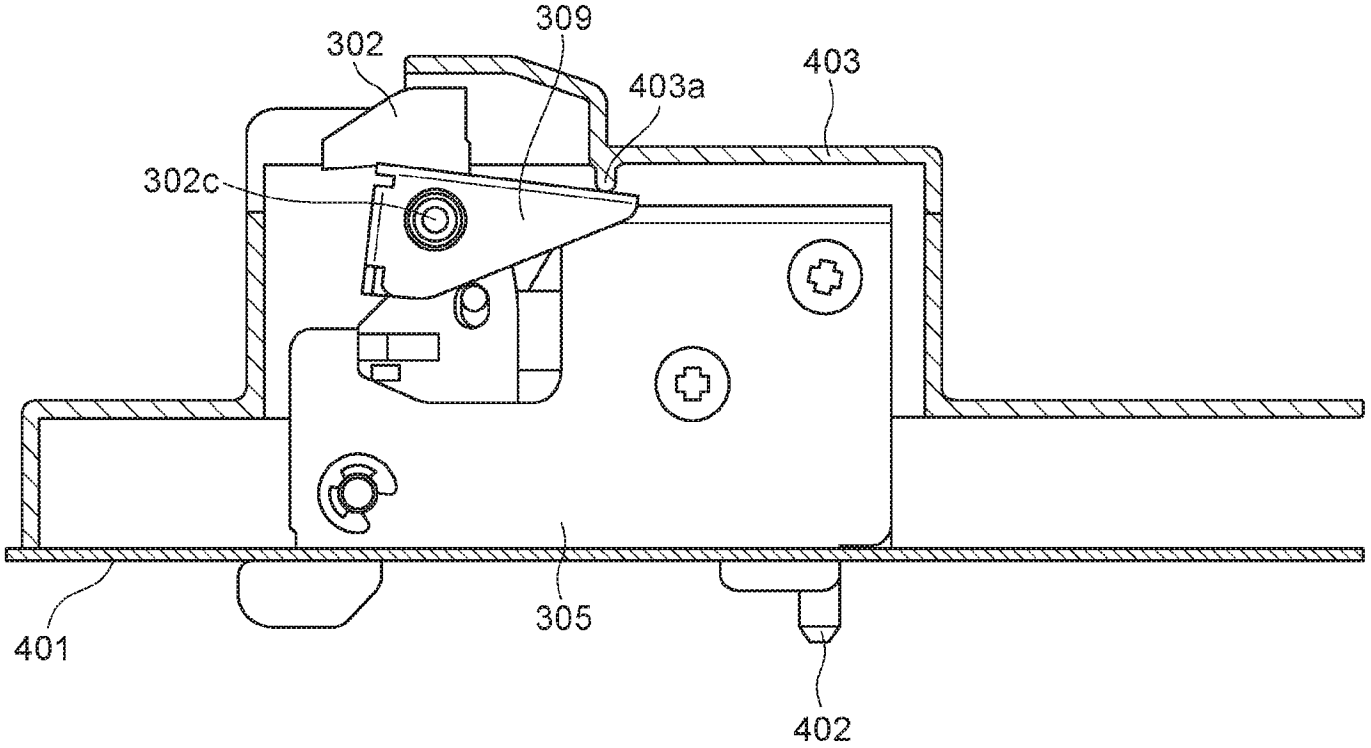
FIG. 23 is an explanatory view showing a state in which the lock unit according to the second embodiment is at the locked position.
Figure 24:
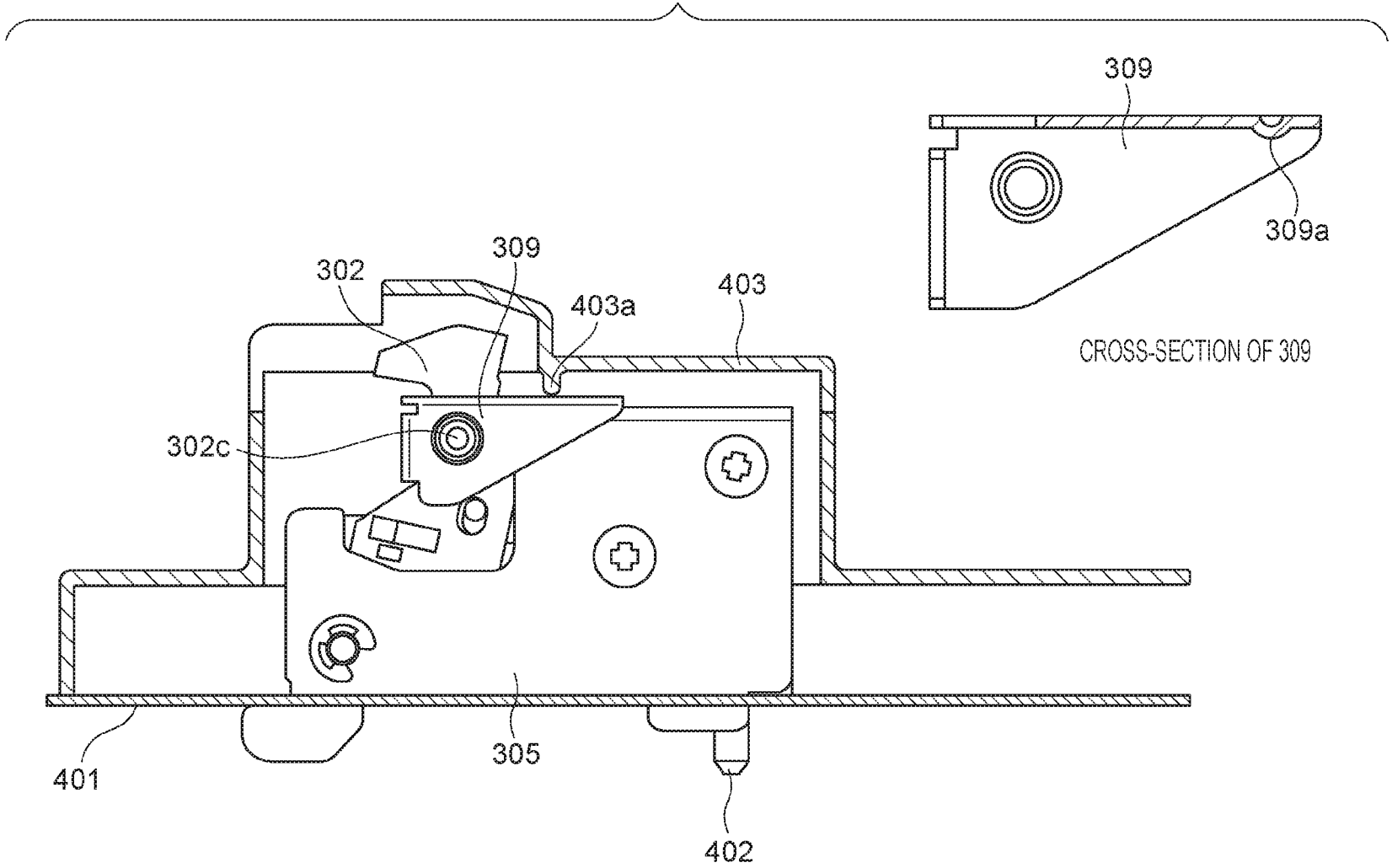
FIG. 24 is an explanatory view showing a state in which the lock unit according to the second embodiment is at the unlocked position.

FIG. 23 shows a state in which the lock lever is located at the locked position. FIG. 24 shows a state in which the lock lever is located at the unlocked position. The lock lever 302 moves between the locked position and the unlocked position. At the time of this movement, the swinging shield plate 309 can move relative to the lock holder 305 and the lock unit cover 403 while swinging about the cylindrical boss 302*c* of the lock lever 302. The spherical drawn portion 309*a* shown in the cross sectional view of the swinging shield plate 309 in the upper right of FIG. 24 slides with the lock holder 305, and the sliding rib 403*a* of the lock unit cover 403 slides with the swinging shield plate 309.

With the above configuration, it is possible to shield the magnetic field from the holding solenoid with the lock holder, the lock lever, and the swinging shield plate. In the first embodiment, since the shield plate is provided in the cartridge door as an openable and closable member, it is impossible to shield the magnetic field in the open state of the openable and closable member. By configuring the shield plate as in this embodiment, it is possible to shield the magnetic field even in the open state of the openable and closable member, and it is possible to increase the degree of freedom in designing the method for opening and closing the openable and closable member.

Third Embodiment

An image forming apparatus having a locking mechanism according to a third embodiment will be described. The same reference numerals or the same member names, even if reference numerals are different, are attached to components configured in the same manner as in the first and second embodiments, and the description thereof will be omitted.

Locking Mechanism

In the first and second embodiments, the configuration in which the lock unit, which is a locking mechanism, is disposed on the front side of the frame of the main body of the image forming apparatus has been described. In this embodiment, the lock unit in the case of being disposed on the far side of the frame will be described.

Figure 11:
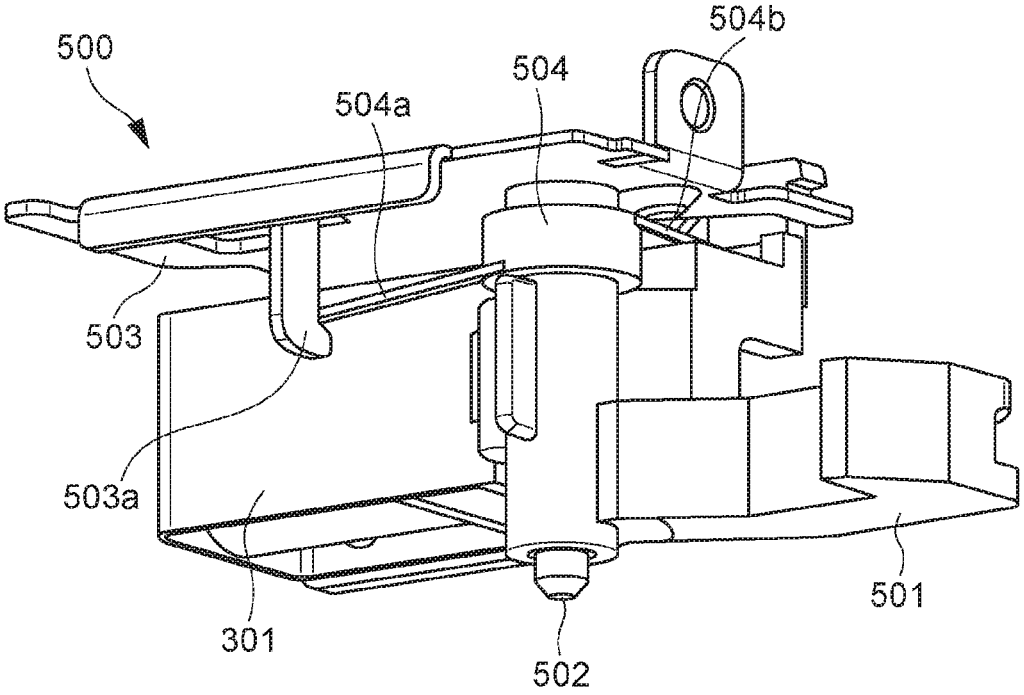
FIG. 11 is a perspective view of a lock unit according to a third embodiment.

As shown in FIG. 11, the lock unit as a locking mechanism includes a holding solenoid 301, a lock lever 501 as a locking member, a lock lever shaft 502, and a pin for connecting (engaging) the lock lever 501 with the holding solenoid 301. The lock unit further includes a lock holder 503, screws for fixing the holding solenoid 301 to the lock holder 503, and a spring 504 as an urging member. The fixed end 504*a* of the spring 504 as an urging member is hooked on a hook portion 503*a* of the lock holder, and the free end 504*b* thereof is hooked on the lock lever. One end of the lock lever shaft 502 is fixed by the lock holder 503, and the other end thereof is fixed by the frame of the apparatus main body. The lock lever 501 is rotatable with respect to the lock lever shaft 502 in a state of being urged by the spring 504.

Figure 12:
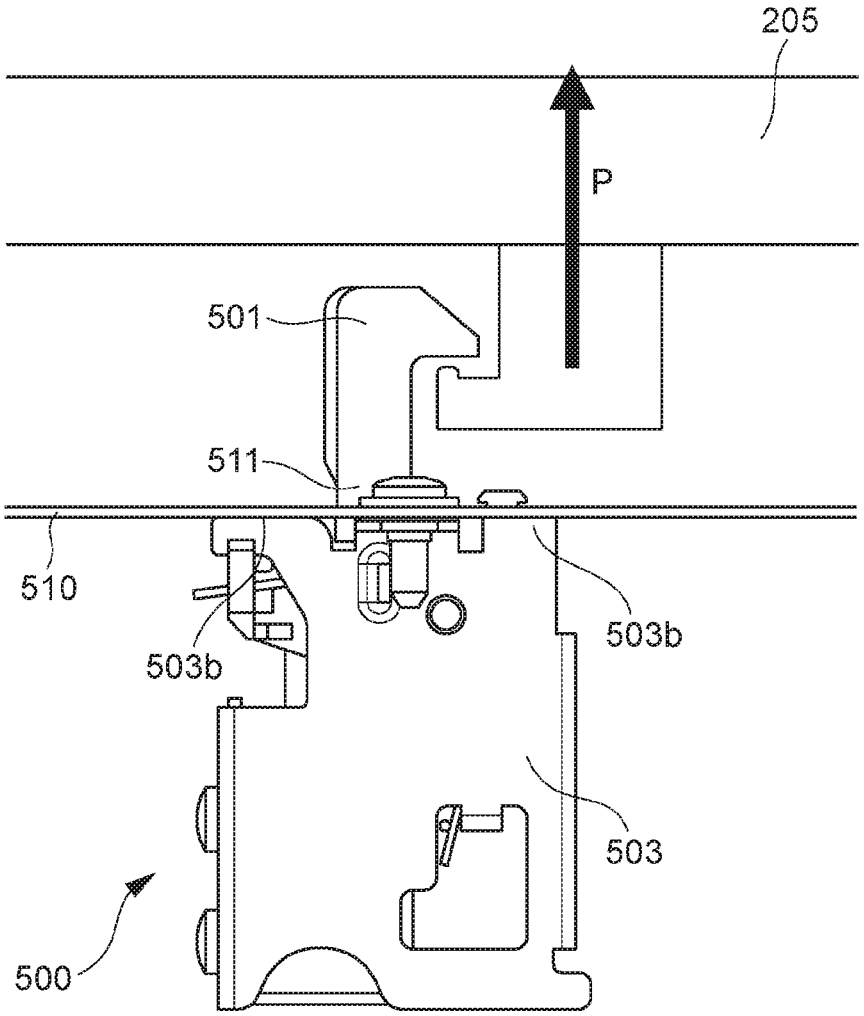
FIG. 12 is a cross-sectional view in the state in which the lock unit according to the third embodiment is attached to the main body of the image forming apparatus.

FIG. 12 shows a state in which the lock unit as a locking mechanism is attached to the main body of the image forming apparatus. An end portion 503*b* of the lock holder contacts the side surface of the apparatus body frame 510, and the lock unit 500 is fixed to the apparatus body frame 510 of the image forming apparatus with a screw 511. When the lock lever 501 is in the locked state and one attempts to open the cartridge door 205 in the P direction, the force is received by the apparatus body frame 510 via the lock unit 500, so that a large force can be withstood.

In this embodiment, since the lock unit is placed in the space in the apparatus body frame 510, the distance from the outside of the main body is increased, and the main body frame shields the magnetic field from the holding solenoid, so that the shield plate required in the first and second embodiments becomes unnecessary.

How Lock Lever Claw Portion and Cartridge Door Latch Portion Receive Force

Figure 13:
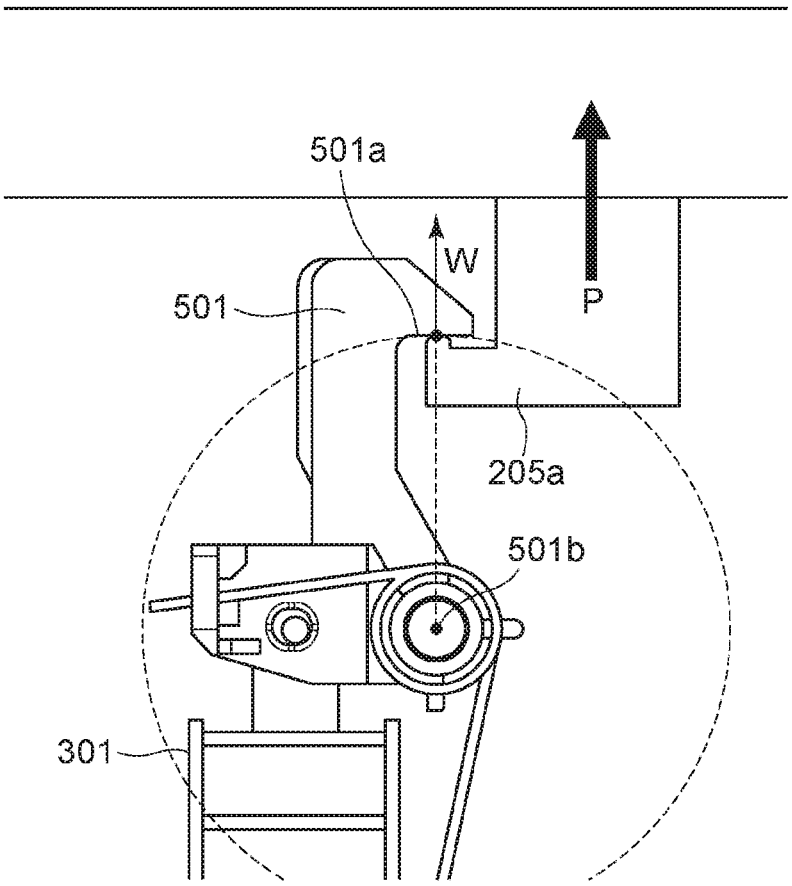
FIG. 13 is a detailed explanatory view of a lock lever claw portion of the third embodiment.

In this embodiment, as shown in FIG. 13, the surface 501*a* of the lock lever claw portion is formed to be concentric with the rotation center 501*b*. In such a configuration, if the user tries to open the cartridge door, the force W input from the latch portion 205*a* to the lock lever 501 acts substantially parallel to the direction P of opening the door. Therefore, the force W is not converted into force in the direction of rotation of the lock lever, and the locked state can be maintained.

Fourth Embodiment

An image forming apparatus having a locking mechanism according to a fourth embodiment will be described. The same reference numerals or the same member names, even if reference numerals are different, are attached to components configured in the same manner as in the first, second, and third embodiments, and the description thereof will be omitted.

Figure 14:
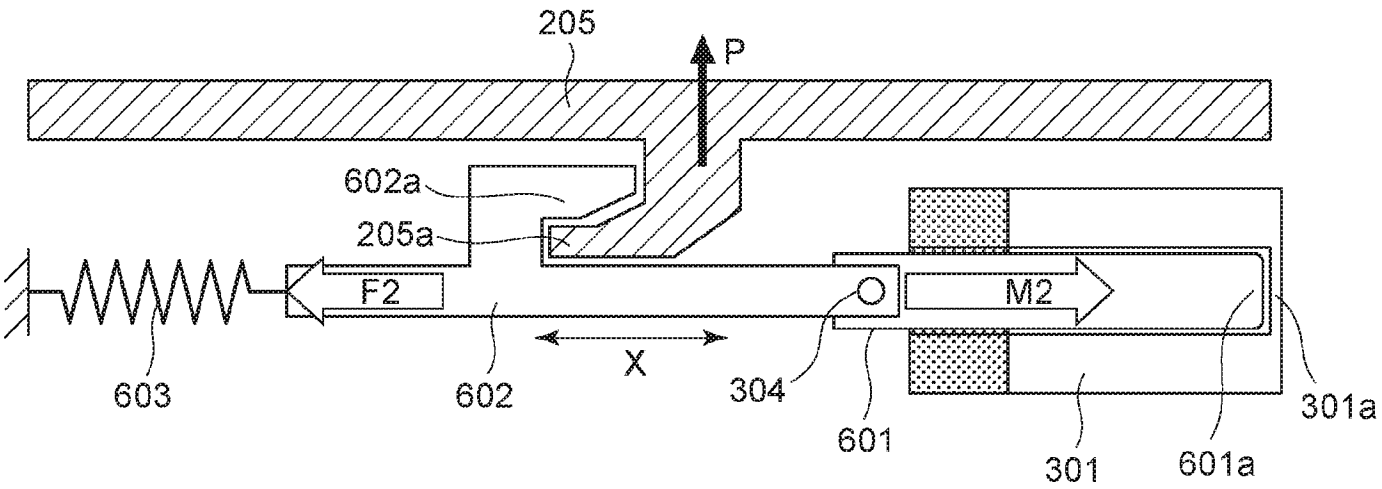
FIG. 14 is a cross-sectional view at the time of locking in the state in which a lock unit according to a fourth embodiment is attached to the main body of the image forming apparatus.
Figure 15:
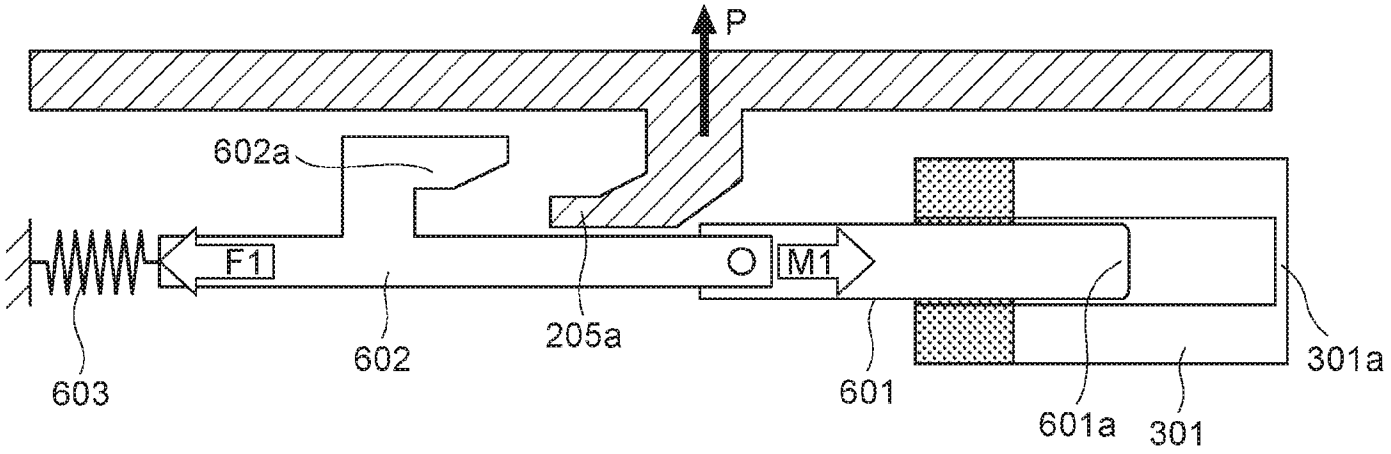
FIG. 15 is a cross-sectional view at the time of unlocking in the state in which the lock unit according to the fourth embodiment is attached to the main body of the image forming apparatus.

The locking mechanism of this embodiment is shown in FIGS. 14 and 15. FIG. 14 shows a locked state in which the openable and closable member is locked, and FIG. 15 shows an unlocked state in which the openable and closable member is unlocked. The locking mechanism of this embodiment mainly includes a holding solenoid 301, a lock lever 602 as a locking member, and a spring 603 as an urging member. The lock lever 602, which is a locking member, is connected (engaged) with the plunger 601 of the holding solenoid via a pin 304. The lock lever 602, which is a locking member, is held slidably in the X direction with respect to the main body of the image forming apparatus and slides in the same direction in conjunction with the sliding operation of the plunger 601. The lock lever 602 has a locking claw 602*a*.

In FIG. 14, the plunger is at the second position, and is in the locked state (locked position) in which the locking member locks the openable and closable member. Similarly, in FIG. 15, the plunger is at the first position, and is in the unlocked state (unlocked position) in which the openable and closable member is unlocked. That is, the locked position is the second position, and the unlocked position is the first position, which is opposite to the position of the first embodiment.

In the state of FIG. 14, since the lock lever, which is a locking member, is engaged with the latch portion 205*a* of the cartridge door, if one tries to open the cartridge door 205 in the P direction, the cartridge door 205 will not open. After the holding solenoid is energized to move the plunger to the first position (that is, after transition to the state of FIG. 15), since the locking claw 602*a* is in the unlocked state retracted from the latch portion 205*a*, the cartridge door 205 can be opened in the P direction.

Next, the relationship between forces will be described. The permanent magnet attractive force M2 by the holding solenoid acts on the right end portion of the lock lever 602 shown in FIG. 14 in the rightward direction, which is the second direction, and the urging force F2 by the spring 603, which is an urging member, acts on the left end portion in the leftward direction, which is the first direction. The tip end 601*a* of the plunger contacts the bottom portion 301*a* of the holding solenoid, so the permanent magnet attractive force M2 is a strong force. By setting the urging force F2 in the first direction to a force smaller than the permanent magnet attractive force M2 in the second direction, the lock lever 602, which is a locking member, is held in the state of being attracted in the rightward direction, which is the second direction. On the other hand, in the state shown in FIG. 15, the plunger tip portion 601*a* separates from the solenoid bottom portion 301*a*, and the permanent magnet attractive force M1 decreases as compared with the permanent magnet attractive force M2. By setting the urging force F1 in the first direction to a force larger than the permanent magnet attractive force M1, the lock lever 602 is held in a state of being attracted in the rightward direction.

In the first embodiment, the second embodiment, and the third embodiment, the state in which the plunger is retracted into the holding solenoid is the unlocked state, whereas in this embodiment, the state in which the plunger is retracted into the holding solenoid is the locked state. The relationship between the position of the plunger of the holding solenoid (retracted state/extruded state) and the lock position (locked state/unlocked state) is not limited to one and can be freely selected depending on the configuration.

In this embodiment, the description has been given of the case where one lock lever claw and one cartridge door claw are engaged by one holding solenoid, but the present invention is not limited thereto. A lock lever that is a locking member and a cartridge door that is an openable and closable member may be provided with a plurality of engaging portions that engage with each other, and a plurality of latches of the cartridge door may be engaged by one holding solenoid.

According to the present invention, it is possible to provide a locking mechanism and an image forming apparatus having a space-saving configuration while reducing temperature rise and power consumption.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-033616 filed Feb. 27, 2018 and No. 2018-211663 filed Nov. 9, 2018, which are hereby incorporated by reference herein in their entirety.

What is claimed is:

1. An image forming apparatus comprising:

an openable and closable member that is openable and closable with respect to a main body of the image forming apparatus;

a locking member that locks the openable and closable member;

an urging member that urges the locking member; and a solenoid including a plunger that is movable in a first direction and a second direction opposite to the first direction and engages with the locking member and urges the locking member, a coil that, when energized, moves the plunger between a first position and a second position moved from the first position in the second direction, and a magnet that exerts a magnetic force on the plunger in a non-excited state, wherein the following expressions are satisfied:

$F2<M2$, and $F1>M1$, where F1 is a force in the first direction with which the urging member urges the locking member when the plunger is at the first position, F2 is a force in the first direction with which the urging member urges the locking member when the plunger is at the second position, M1 is a force in the second direction acting on the plunger from the magnet when the plunger is at the first position, and M2 is a force in the second direction acting on the plunger from the magnet when the plunger is at the second position, and wherein the following expressions are satisfied:

$F1<M1+E$, and $F2+R>M2$, where E is a force generated from the coil to move the plunger in the first direction, and R is a force generated from the coil to move the plunger in the second direction.

2. The image forming apparatus according to claim 1, further comprising a cartridge detachably attachable to the main body of the image forming apparatus, wherein the openable and closable member is movable between a first opening position where the cartridge is exposed and a second closing position where the cartridge is covered.

3. The image forming apparatus according to claim 1, wherein the locking member has a surface contacting with the openable and closable member, and wherein in the closed state of the openable and closable member, the surface is inclined with respect to the surface of the openable and closable member.

4. The image forming apparatus according to claim 1, wherein the locking member is movable between a locked position where the openable and closable member is locked and an unlocked position where the openable and closable member is unlocked, and wherein the urging member urges the locking member in a direction in which the locking member moves to the locked position.

5. The image forming apparatus according to claim 1, wherein a ferromagnetic material is placed at a position that is at least a part of the openable and closable member and shields a magnetic field emitted from the solenoid to the outside of the image forming apparatus.

6. The image forming apparatus according to claim 1, wherein at least a part of the locking member is provided with a ferromagnetic material for shielding a magnetic field emitted from the solenoid.

7. The image forming apparatus according to claim 1, wherein the solenoid is placed in the main body made of a ferromagnetic material.

8. An image forming apparatus comprising:

an openable and closable member that is openable and closable with respect to a main body of the image forming apparatus;

a locking member that locks the openable and closable member;

an urging member that urges the locking member; and a solenoid including a plunger that is movable in a first direction and a second direction opposite to the first direction and engages with the locking member and urges the locking member, a coil that, when energized, moves the plunger between a first position and a second position moved from the first position in the second direction, and a magnet that exerts a magnetic force on the plunger in a non-excited state, wherein the following expressions are satisfied:

$$F1<M1, \text{ and}$$

$$F2>M2,$$

where F1 is a force in the second direction with which the urging member urges the locking member when the plunger is at the first position, F2 is a force in the second direction with which the urging member urges the locking member when the plunger is at the second position, M1 is a force in the first direction acting on the plunger from the magnet when the plunger is at the first position, and M2 is a force in the first direction acting on the plunger from the magnet when the plunger is at the second position, and wherein the following expressions are satisfied:

$$F2<M2+R, \text{ and}$$

$$F1+E>M1,$$

where E is a force generated from the coil to move the plunger in the second direction, and R is a force generated from the coil to move the plunger in the first direction.

9. The image forming apparatus according to claim 8, wherein the locking member is movable between a locked position where the openable and closable member is locked and an unlocked position where the openable and closable member is unlocked, and wherein the urging member urges the locking member in a direction in which the locking member moves to the unlocked position.

* * * * *